US006109339A

United States Patent [19]

Talbert et al.

[11] Patent Number: 6,109,339

[45] Date of Patent: Aug. 29, 2000

[54] HEATING SYSTEM

[75] Inventors: Sherwood G. Talbert, Columbus; David A. Ball, Westerville; Jan B. Yates, Reynoldsburg; Stephen E. Petty, Dublin; Steve Grimes, Westerville, all of Ohio

[73] Assignee: First Company, Inc., Dallas, Tex.

[21] Appl. No.: 08/745,301

[22] Filed: Nov. 8, 1996

Related U.S. Application Data

[60] Provisional application No. 60/021,782, Jul. 15, 1996.

[51] Int. Cl.[7] ..... F25B 29/00

[52] U.S. Cl. ..... 165/48.1; 165/58; 165/10; 126/101; 237/19; 454/243

[58] Field of Search ..... 237/19, 12.3 B; 165/10, 48.1, 58; 126/101; 454/243; 122/20 A, 20 B

[56] References Cited

U.S. PATENT DOCUMENTS

| | | | |
|---|---|---|---|
| 2,294,579 | 9/1942 | Sherman | 126/101 |
| 2,354,507 | 7/1944 | Doherty | 126/101 |
| 2,476,018 | 7/1949 | Young et al. | 165/236 |
| 2,529,977 | 11/1950 | Thomas | 126/101 |
| 2,573,364 | 10/1951 | Scharff | 126/101 |
| 2,616,412 | 11/1952 | Backus | 126/101 |
| 2,755,794 | 7/1956 | Wendell | 454/243 |
| 2,822,136 | 2/1958 | Dalin | 237/17 |
| 2,833,267 | 5/1958 | Handley | 126/101 |
| 2,840,101 | 6/1958 | Saylor | 137/335 |
| 2,998,003 | 8/1961 | Grooms, Jr. | 126/101 |
| 3,181,793 | 5/1965 | MacCracken et al. | 237/2 |
| 3,236,226 | 2/1966 | Eubanks | 126/101 |
| 3,269,382 | 8/1966 | Ronan et al. | 126/101 |
| 3,307,471 | 3/1967 | Gacioch | 98/62 |
| 3,428,040 | 2/1969 | Baker et al. | 126/110 |
| 3,521,547 | 7/1970 | Hodges | 454/243 |
| 3,563,225 | 2/1971 | Masrieh | 126/101 |
| 3,662,735 | 5/1972 | Jackson | 126/85 B |
| 3,749,157 | 7/1973 | Davison | 165/48 |
| 3,833,170 | 9/1974 | Marshall | 236/9 R |

(List continued on next page.)

FOREIGN PATENT DOCUMENTS

| | | | |
|---|---|---|---|
| 63-49640 | 2/1988 | Japan | 237/19 |

OTHER PUBLICATIONS

Glowcore Engineering/Design Manual, Glowcore Corporation; Cleveland, OH, 1992.

*Primary Examiner*—John K. Ford
*Attorney, Agent, or Firm*—Philip J. Pollick

[57] ABSTRACT

A heating system uses a dynamic thermal stabilizer for receiving, mixing, holding and outputting a circulating heat exchange liquid in a fashion similar to the use of a flywheel in the mechanical arts. Liquid is returned to the dynamic thermal stabilizer from both an input heat exchange unit and an output heat exchange unit. A two pump system affords a simple tee fitting arrangement that provides room air heating by directly using hot liquid either from the dynamic thermal stabilizer or directly (and at higher temperature) from the input heat exchange unit itself to automatically achieve an additional boost of room heat using higher temperature liquid. The system can also provide initial short draws of domestic hot water from the dynamic thermal stabilizer alone or long draws of hot water by using the input heat exchange unit as a further source of heat input. The system includes a through-the-wall mounting system that simultaneously provides a source of combustion air and vents exhaust products, a spacer to maintain combustion air and exhaust pipes in spaced-apart relation, and a vent device for maintaining a cool, outer-vent surface. The system is combined with an air conditioning or heat pump system to provide a triple integrated appliance that provides room air heating and cooling and a source of domestic hot water.

42 Claims, 13 Drawing Sheets

U.S. PATENT DOCUMENTS

| | | | |
|---|---|---|---|
| 4,072,187 | 2/1978 | Lodge | 165/48 |
| 4,178,907 | 12/1979 | Sweat, Jr. | 126/101 |
| 4,340,174 | 7/1982 | Regan | 237/19 |
| 4,371,111 | 2/1983 | Pernosky | 237/8 R |
| 4,415,119 | 11/1983 | Borking et al. | 237/19 |
| 4,541,410 | 9/1985 | Jatana | 126/362 |
| 4,627,416 | 12/1986 | Ito et al. | 126/351 |
| 4,638,943 | 1/1987 | Casier et al. | 237/7 |
| 4,640,458 | 2/1987 | Casier et al. | 237/17 |
| 4,641,631 | 2/1987 | Jatana | 126/101 |
| 4,651,710 | 3/1987 | Henault | 126/85 B |
| 4,671,459 | 6/1987 | Stapensea | 237/8 R |
| 4,748,968 | 6/1988 | Vrij | 126/100 |
| 4,798,240 | 1/1989 | Gerstmann et al. | 165/48.1 |
| 4,805,590 | 2/1989 | Farina et al. | 126/101 |
| 4,819,587 | 4/1989 | Tsutsui et al. | 122/488 R |
| 4,823,770 | 4/1989 | Loeffler | 126/362 |
| 4,828,171 | 5/1989 | Akin, Jr. et al. | 237/19 |
| 4,848,655 | 7/1989 | Woodin et al. | 237/8 R |
| 4,925,093 | 5/1990 | Moore, Jr. et al. | 237/19 |
| 4,971,025 | 11/1990 | Mariani | 126/101 |
| 4,993,402 | 2/1991 | Ripka | 126/361 |
| 5,037,510 | 8/1991 | Nygards | 202/83 |
| 5,039,007 | 8/1991 | Wolter | 136/12.1 |
| 5,046,478 | 9/1991 | Clawson | 126/110 R |
| 5,074,464 | 12/1991 | Moore, Jr. et al. | 237/19 |
| 5,076,494 | 12/1991 | Ripka | 237/19 |
| 5,211,334 | 5/1993 | Schatz | 237/12.3 B |
| 5,248,085 | 9/1993 | Jensen | 237/19 |
| 5,249,742 | 10/1993 | Atterbury et al. | 237/12.3 B |
| 5,361,751 | 11/1994 | Biggs | 126/101 |
| 5,415,133 | 5/1995 | Noh | 122/16 |
| 5,470,019 | 11/1995 | Martenson | 237/19 |

HEATING SYSTEM

CROSS REFERENCE TO RELATED APPLICATION

This application claims the benefit of U.S. provisional application 60/021,782 filed on Jul. 15, 1996 all of which is incorporated by reference as if completely written herein.

BACKGROUND OF THE INVENTION

1. Field of the Invention

This invention relates generally to heating systems and more particularly to a heating system employing a dynamic thermal stabilizer for receiving, mixing, holding and outputting a circulating fluid received from both an input heat exchange unit and an output heat exchange unit. The system affords room air heating and domestic water heating by using heated water from the dynamic thermal stabilizer alone or in combination with the input heat exchange unit when additional heat input is required. The heating system is combined with an air conditioner or heat pump to afford a triple integrated, air cooling, air heating, and domestic hot water supply system.

2. Background

Over the years, housing apartment units and especially multi-family units have employed a wide variety of heating systems for both room air space heating and potable water heating. Multi-family units have often employed a central heat source such as a boiler or forced-air system using gas-fired or electric resistance furnaces for room air heating. Just as common is the use of individual heating devices (gas or oil furnace, electric heat pump, or electric resistance heating) in each unit. Domestic hot water is typically supplied from a central source although it is not uncommon to have individual electric or gas water heaters in each unit of a multi-family complex. Finally most dwelling units are air conditioned, either from a central chilled water source, window air conditioners, or by use of individual heat pumps that provide both heating and cooling.

Needless to say such configurations require considerable amounts of individual dwelling unit space or costly duct work and plumbing when central heating units, cooling units, and domestic water supplies are used. From a developer's point of view, either of these options is costly and a need exists to develop a single compact package that provides room air heating, domestic water heating, and air conditioning into a single efficient unit with minimum operating space and cost.

A wide variety of approaches have been made in an effort to solve these problems. In the area of potable water and room air heating, one approach has been the direct heating of a potable-water tank with the heated, potable water being used with a separate water-to-air exchanger for room heating. Typically these designs focus on improving the heat exchange from the combustion gases to the water tank, e.g., Marshall (U.S. Pat. No. 3,833,170), Sweat (U.S. Pat. No. 4,178,907), Jatana (U.S. Pat. No. 4,451,410 and U.S. Pat. No. 4,641,631), Moore Jr. (U.S. Pat. No. 4,925,093 and U.S. Pat. No. 5,074,464), Ripka (U.S. Pat. No. 5,076,494) and Noh (U.S. Pat. No. 5,415,133). As a second embodiment, Ripka (U.S. Pat. No. 5,076,494) uses an additional set of coils within the water tank to form a closed-loop, non-potable liquid, heat-exchange system for heat exchange between the room heating air exchanger and the potable-water tank Pernosky (U.S. Pat. No. 4,178,907) uses warm combustion gases from initial water-tank heating to further heat the potable water prior to its delivery to the room-heating air exchanger. Cashier (U.S. Pat. No. 4,640,458) and Ripka (U.S. Pat. No. 4,939,402) use the warm combustion gases from water-tank heating to preheat cold, potable water prior to entry into the water tank.

Because these approaches use the water tank as a single source of hot potable water for both the domestic hot water supply and room heating, the water tanks must be large in order to provide the needed hot water for both space heating and domestic use. Moreover, the arrangements tend to be complex as various heat exchange features are incorporated in or used with the water tank In a related approach, Handley (U.S. Pat. No. 2,833,267), Dalin (U.S. Pat. No. 2,822,136), Grooms, Jr. (U.S. Pat. No. 2,998,003), Ronan (U.S. Pat. No. 3,269,382) and Masrich (U.S. Pat. No. 3,563,225) use the combustion gases from heating the potable-water tank and the heat from the tank itself to heat room air. Eubanks (U.S. Pat. No. 3,236,228) uses an arrangement of multiple, coaxial, double heat-exchange tubes in which combustion gases in the inner coaxial tubes heat potable water flowing in the outer coaxial tubes which in turn heat room air flowing over the exterior of the outer coaxial tubes. The outer tubes and headers at each end of the outer tubes serve as the hot water storage tank. In such systems, the elaborate and intricate heat exchange paths increase fabrication costs and tend to be difficult to access and service.

In a second approach that emphasizes space heating, combustion gases from direct air heating or the resulting heated air itself are used to heat a potable-water tank. Doherty (U.S. Pat. No. 2,354,507) and Biggs (U.S. Pat. No. 5,361,751) use warm combustion gases from a space-heating, combustion-gas exchanger to further heat potable water in a water tank. In both cases, direct combustion gas heating of the tank is also provided. Because of the need for dual burners, one in the hot-air furnace and the other for the water tank design, such devices tend to be large in size as a result of the dual combustion gas, room air, and potable water heat-exchange requirements. Mariani (U.S. Pat. No. 4,971,025) uses a central combustion chamber to heat room air in an annular chamber surrounding the combustion chamber with heat from the hot room air also used to heat a potable-water tank. Such an arrangement tends to be somewhat inefficient for water heating especially when room heating is not required because of the double heat exchange from combustion gas, to air, to the hot-water container for potable water heating.

A third approach to potable-water heating involves direct heat exchange from the combustion gases to the potable water without use of a water tank. Such devices are typically referred to as instantaneous, hot water units. Saylor (U.S. Pat. No. 2,840,101) illustrates an early design directed only to water heating. Tsutsui (U.S. Pat. No. 4,819,587) illustrates a gas burner ignition device while Ito et al. (U.S. Pat. No. 4,627,416) illustrates a burner diaphragm valve responsive to a vacuum produced by water flowing through the heat exchanger. Woodin (U.S. Pat. No. 4,848,416) and Wolter (U.S. Pat. No. 5,039,007) illustrate an instantaneous heat exchanger that provides hot, potable water that is also used for air heating. Clawson (U.S. Pat. No. 5,046,478) uses a high dew-point, combustion gas heat exchanger for heating potable water that is used for air heating and stored in a water tank for domestic use. In the Clawson design, water from the room heat exchanger is returned directly to the combustion gas heat exchanger. A diverter valve and a flow control valve regulates the flow of hot water from the combustion gas heat exchanger to either the room-air heat exchanger or to the water tank.

In a variation of the combustion-gas/potable-water heat exchanger system design, the hot, potable water is stored in a hot-water tank but the hot water is not used for space heating. Rather, room air heating is carried out with a room air/combustion-gas exchanger. Sherman (U.S. Pat. No. 2,294,579), Thomas (U.S. Pat. No. 5,529,977), and McCracken (U.S. Pat. No. 3,181,793) are illustrative of this design. Typically such units tend to be large in size because of the additional air/combustion gas exchanger requirements and complex with attendant high fabrication, installation and service costs as a result of the integration of the combustion gas/air and liquid exchangers. Such units tend to be inefficient as a result of high heat loss after the heat demand it met. Because of high on/off cycling, exchanger corrosion tends to be high and component controls, valves, ignitors, etc. are subject to high rates of wear.

In a fourth approach to potable water and room air heating, Vrij (U.S. Pat. No. 4,748,968), Loeffler (U.S. Pat. No. 4,823,770) and Martensson (U.S. Pat. No. 5,470,019) heat a non-potable liquid in a tank and use the resulting hot liquid to heat room air with an air/non-potable liquid exchanger. Potable water is heated with an exchange coil placed inside of the non-potable liquid tank. Borking et al. (U.S. Pat. No. 4,415,119) uses a combination of tanks, or heat exchangers, or both within the non-potable water tank for the hot, potable water supply. As with potable-water tanks, the tanks must be large and the location of heat-exchangers within the tank increases with manufacturing and service costs. Regan (U.S. Pat. No. 4,340,174) combines a heated potable water tank and a heated non-potable water tank (for space heating) into a single device where the combustion gases from non-potable tank heating augment potable water tank heating.

Finally, the last approach to room air and potable-water heating involves the use of combustion gas to heat a non-potable liquid using a heat exchanger. As seen in Casier (U.S. Pat. No. 4,638,943), Gerstmann et al. (U.S. Pat. No. 4,798,240), Farina (U.S. Pat. No. 4,805,590), Stapensea (U.S. Pat. No. 4,671,459), Jensen (U.S. Pat. No. 5,248,085) and the GlowCore products (Cleveland, Ohio; *GlowCore Engineering/Design Manual,* 1992), the hot, non-potable liquid from the combustion-gas exchanger is then used to 1) heat room air using an air/non- potable liquid heat exchanger or 2) to heat potable water in a potable-water tank using a potable-water/non-potable liquid heat exchanger. Gerstmann et al., in an alternative embodiment, directs hot, non-potable liquid to a non-potable liquid tank where it is used to heat potable water with a potable-water heat exchanger. In each of these "parallel processing" systems, one or more valves divert hot, non-potable liquid either to the air heating or to potable-water heating function. In all cases, the non-potable water from either the room air heat exchanger or the potable water exchanger is returned directly to the combustion gas/non-potable liquid exchanger. Sharff (U.S. Pat. No. 2,573,364) uses a closed-loop, "sequential processing" arrangement of the following components: 1) a combustion gas/non-potable liquid exchanger, 2) a non-potable liquid/air exchanger, and 3) a non-potable liquid tank with potable water exchange coil. Because the combustion gas/liquid heat exchanger must be operating for either hot-liquid or air heating, an undue load is placed on the combustion-gas exchanger causing excessive on/off cycling, high corrosion rates, and undue wear and tear on system switching components such as valves and switching devices and ignition systems. Moreover the combustion gas exchanger is mismatched with regard to the air and potable water heating requirements.

In summary, efforts to use conventional direct-fired, potable water or non-potable liquid tanks as a source of hot water from a room-air heater require large potable-water or non-potable liquid storage tanks in order to provide the needed hot water or liquid for both space heating and domestic, hot-water purposes. Instantaneous heaters, that is, combustion gas/liquid heat exchangers used for both space and domestic water heating tend to be inefficient as a result of the large amount of heat loss after the heating demand has been met. Further, instantaneous-type systems experience a high rate of on/off cycling tending to incur high rates of corrosion and fatigue with an undue burden on switching components, ignition systems and valves. In addition, both the potable water and non-potable liquid/combustion gas exchanger systems require large combustion gas/liquid exchangers to meet high, hot, potable-water loads such as with twenty-minute shower use. As a result, such designs produce a combustion-gas/liquid exchanger mismatch between the space heating and potable water heating needs of the typical user.

Turning to the field of combined potable-water heating, air heating, and air conditioning units, the following approaches have been taken. Davidson (U.S. Pat. No. 3,749,157) uses a blower assembly with a rotating diverter to direct room air through either a cooling compartment or heating compartment of an integrated unit which also includes a separate hot water tank for domestic water purposes. Lodge (U.S. Pat. No. 4,072,187) is directed to a modular air cooling and heating device using individual blowers for each function The unit is mountable in-wall but does not provide for domestic-water heating. A preference for avoiding circulating fluids for space heating also is noted. Akin, Jr. (U.S. Pat. No. 4,828,171) is directed to an in-wall cabinet for housing a through-the-wall, gas-fired water tank and air heating unit along with an electric air conditioning unit. Gerstmann et al. (U.S. Pat. No. 4,798,240) provides a through-the-wall cabinet for an integrated water tank and room-air heat exchanger which are heated with a condensing combustion gas/non-potable liquid heat exchanger. The combustion gas/non-potable liquid exchanger uses a three-way valve assembly for heating either the potable water tank or the room-air exchanger. In either case, the liquid is returned directly to the combustion gas exchanger. The use of a condensing combustion gas/liquid exchanger requires a condensation drain tending to cause icing problems at the terminal vent under cold ambient conditions. The use of an open reservoir in the non-potable liquid system is subject to evaporation of the liquid with resulting maintenance problems. The hot water storage tank is large (thirty gallons) and the arrangement and accessibility of components within the housing present access problems when maintenance is required.

Finally in using some of the various prior art devices, it is desirable to mount the device through an exterior wall in order to minimize air and combustion gas handling vent and duct work, e.g., Gerstmann et al. (U.S. Pat. No. 4,798,240) and Akin, Jr. (U.S. Pat. No. 4,828,171). Of particular interest has been a combined combustion air/combustion gas design to supply combustion air from an outside source and exhaust combustion gases in a closed system. To this end, Baker et al. (U.S. Pat. No. 3,428,040) and Jackson (U.S. Pat. No. 3,662,735) use a coaxial tube arrangement in which the inner exhaust tube is aligned with a hole in the gas heater fire box. Henault (U.S. Pat. No. 4,651,710) uses a support plate having wing tabs that align with slots in angle iron fittings attached to the heating unit to align the heating unit with a through-the-wall coaxial exhaust and combustion air system. The match of the tab and slot arrangement, especially for larger units in confined spaces is time-consuming and increases the installation costs of the heating unit. Further, the exposure of hot exhaust pipes, especially at low elevational levels, can burn or scorch objects that contact the exhaust outlet.

It is an object of the present invention to simplify individual component construction of an integrated hot combustion product/liquid exchanger for space-heating or liquid heating or both.

It is an object present invention to reduce thermal loss encountered with instantaneous combustion gas/liquid heating devices.

It is an object of the present invention to reduce the size of tank components with liquid tank/combustion product devices used for both air and liquid heating.

It is an object of the present invention to reduce cycling wear on valves, ignitors, and electrical components associated especially with combustion product/liquid heat exchangers.

It is an object of the present invention to reduce overall system complexity of an integrated combustion product/liquid exchanger and air or liquid heating unit.

It is an object of the present invention to integrate a hot combustion product/liquid heat exchanger for liquid and air heating purposes with an air cooling device.

It is an object of the present invention to provide a through-the-wall combustion air and exhaust system that is easy to install and connect to a heating unit assembly.

It is an object of the present invention to more evenly match air and liquid heating needs with the heating capacity of a combustion product/liquid heat exchanger.

It is an object of the present invention to reduce air handling duct work and gas and liquid piping requirements.

It is an object of the present invention to provide a warm heat as is beneficial in daily living and especially in assisted care facilities.

It is an object of the present invention to provide a cool surface at the point where the exhaust gas is vented to the outdoors.

It is an object of the present invention to provide a safe and simple electrical control system.

SUMMARY OF THE INVENTION

To meet these objectives, the present invention features the use of a dynamic thermal stabilizer that holds a volume of liquid and is arranged to receive, store, mix, and output the liquid for additional heat input or as a source of hot liquid that can be used for subsequent heating purposes. In addition to the dynamic thermal stabilizer, the heating system of this invention has an input heat exchange unit for heating the liquid 1) by direct combustion means such as by the hot combustion products from the combustion of gas, oil, and other fossil and synthetic fuels, 2) by a heating element such as an electrical resistance element or 3) by heat exchange with a hot fluid such as steam or other hot gases and liquids. The system also has an output heat exchange unit that uses the hot liquid from either the dynamic thermal stabilizer or the input heat exchange unit for heating purposes such as to heat room air or other gases, liquids and solids.

The dynamic thermal stabilizer, the input heat exchanger, and the output heat exchanger are interconnected so that 1) the dynamic thermal stabilizer is capable of receiving liquid directly from the input heat exchange unit and directly from the output heat exchange unit, 2) the input heat exchange unit is capable of receiving liquid directly from the dynamic thermal stabilizer, and 3) the output heat exchanger is capable of receiving liquid from the input heat exchange unit.

The use of the dynamic thermal stabilizer is especially advantageous in that it allows low levels of heating and liquid draw to be provided by the stabilizer itself without having to invoke the heating input of the input heat exchange unit. This has the advantage of reducing cycling of the input heat exchange unit, that is, on and off operation, and attendant wear and tear on the input heat exchange parts such as the burner, ignitor, fuel supply valves, electrical switches and relays. Such reduced operation also helps to avoid corrosion and other undesirable heat effects such as heat exchanger metal fatigue due to continual cycling between hot and cold temperatures.

As will be discussed more fully in the detailed description, the invention contemplates the use of a wide variety of conventional component connections, check valves, pumps, mixing valves, and piping. One particular arrangement, features the use of a simple tee and two pumps arranged so that the output heat exchange unit is connected to receive selectively the liquid from the input heat-exchange means and the dynamic thermal stabilizer. That is, hot liquid can be drawn directly from the dynamic thermal stabilizer for use in the output heat exchange unit, or it can be drawn directly from the input heat exchanger to provide additional heating capacity at the output heat-exchange unit. Such an arrangement allows hot liquid from the input heat exchanger to be used directly in the output heat exchange unit thereby providing the liquid at a higher temperature and giving an extra, high-temperature heating boost when the output heat exchanger is operating, for example as a room air heater. This arrangement also allows the operation of the input heat exchanger and the output heat exchanger to be independent of one another, with each heat exchanger being controlled by separate thermostats. By drawing the liquid directly from the dynamic thermal stabilizing unit to the output heat exchanger when less heating capacity is required, undue liquid cooling is avoided that might otherwise result by having to pass the liquid through an inoperative input heat-exchange unit.

Although the two pump design has been found to be particularly advantageous, it is to be realized that one pump operation can be achieved with the use of appropriate valves to control the flow through the three components. Such a pump is typically located between the dynamic thermal stabilizer and the input heat exchange unit. When a second pump is used, especially when used with the simple tee fitting noted above, it is located between the output heat exchange means and the dynamic thermal stabilizer. The heating system can be used as either a closed liquid system in which a good heat transfer fluid circulates in closed loop fashion or as an open liquid system in which liquid is added to and withdrawn from the system. An open liquid system is especially attractive when the liquid is water and especially potable water as provided by a pressurized water system. Such a system can not only provide room air and other heating via the output heat exchange unit but also can provide potable hot water for domestic use.

In an open system, the dynamic thermal stabilizer is connected to receive cold water from a water source with the dynamic thermal stabilizer further connected to deliver hot water to a hot water output. When used for domestic purposes, an "anti-scald" mixing device can be used to prevent burns from unduly hot water. The mixing device receives hot water from the hot water output and cold water from the water source and delivers water at a preselected temperature, e.g., typically 120–140° F., to a heated water output such as a shower, sink, dishwasher, clothes washer, or other appliance.

When demands are made for both room air heating and hot water draw during periods of low outdoor temperatures, it is advantageous to prioritize these demands. Typically the hot water draw is of greater significance and thus is given higher priority. For example, to maintain long periods of hot water draw from the dynamic thermal stabilizer as, for example, to take a twenty minute shower, it has been found advantageous to direct the heat input from the input heat-exchange unit solely to water heating for the hot water draw. To accomplish this, the invention features a sensing device located in proximity to the cold water inlet to the dynamic thermal stabilizer. The sensing device is typically a temperature sensor that detects the drop in input conduit temperature as cold water flows into the dynamic thermal stabilizer. Other sensors such as a cold water input flow sensor can also be used. A change in the detected property, e.g., temperature or flow, typically causes a control to regulate or stop hot liquid flow to the output heat exchanger. For example, a drop in temperature at the cold water input to the dynamic thermal stabilizer activates a control such as a thermal switch that interrupts the room thermostat circuit and turns off a pump or valve that controls circulation of hot liquid through the output heat exchanger.

To provide a compact arrangement for a portion of the system components, the invention features a subunit housing that contains the input heat-exchange unit, the dynamic thermal stabilizer, and associated pumping, valves, and electrical controls. This has the advantage of providing a component package that is easy to install and access or remove for servicing.

To provide greater efficiency, the invention features the use of thermal insulating material such as glass fiber or rockwool insulation that surrounds at least a portion of the dynamic thermal stabilizer to prevent undue loss of liquid heat. When a cylindrical dynamic thermal stabilizer is used, the various conduit (pipe) fittings to the dynamic thermal stabilizer tank can be permanently affixed and sealed to the tank by conventional joining techniques such as soldering, welding or brazing and the dynamic thermal stabilizer can be cast in a rigid form insulating material such as a foamed polyurethane. Casting the exterior surface of the rigid insulating material to conform to at least two sides of the subunit housing has the advantage of allowing the dynamic thermal stabilizer to be quickly located within the subunit housing for subsequent connections to other system components. The rigid insulation can be formed as a single piece or, when ready access to the stabilizer tank is desired, as two or more pieces.

A wide variety of input heat exchange units can be used with the invention including units heated with the combustion products from fossil and synthetic fuels, steam, and even electrical resistance heaters. Illustrative of such input heat exchange units is a natural or synthetic gas combustion unit. Such a unit typically has an input heat exchanger housing which contains a source of fuel, a fuel oxidizing source such as air, a burner for igniting and burning the fuel to provide combustion products to heat an input heat exchanger with the input heat exchanger transferring heat from the hot combustion products to the system liquid, and an exhaust flue attached to the input heat exchanger housing for venting combustion products from the burner to the outdoors. A typical input heat exchanger consists of a fined tube wound into a helical coil with the fins of adjacent turns of the coil in contact with each other and forming passages between the adjacent coil turns. The burner is positioned so that the hot combustion products achieve good contact with the fins and outer surface of the helical coil tube so that maximum heat is transferred to the liquid flowing through the interior of the coil tube. Typically the burner is placed at the center of the helical coil with the hot combustion products moving radially outward and around the coil windings, passing between the coil winding in the apertures formed by the contacting fins and then out through an exhaust flue.

To increase the heat exchange of the combustion products with the heat exchange coil, the invention features a device for deflecting hot combustion products around the circumference of the finned coil tubing to promote greater contact of the hot combustion products with the fins and exterior tubing surfaces. One embodiment to achieve this objective is an annular apertured shroud that surrounds the heat exchange coil. By aligning shroud apertures with the outermost radial extension of each coil winding, maximum contact of the hot combustion products around the circumference of the finned coil is achieved. By forming the shroud with a helical groove, the heat exchange coil can be screwed into the mating shroud groove with the resulting advantage of maintaining each coil turn in contact with adjacent turns and also providing correct position of the shroud apertures with the outermost radial extension of the coil windings. The combustion products flow from the burner located at the center of the coil, over and between the coil fins, and out through the shroud apertures and are exhausted from the input heat exchanger housing through a flue (exhaust vent pipe or other suitable conduit) attached to the exchanger housing. The flue is received through a cutout in the subunit housing, which, for a closed-air sealed combustion system, can provide a path for both combustion air and exhaust products. A suitable direct-vent arrangement of input air and exhaust conduits provides for through the wall communication with the outdoor environment.

In certain instances, it may be difficult to unwind the coil to form suitable connections after the shroud has been screwed into place. In such instances, the shroud can be formed as two separate semi-cylindrical pieces with extending flanges that can be secured to each other. In other variations, a band or high-temperature cord can be spirally wound about the coil so as to cover the coil windings at their point of proximity or contact with each other. As with the shroud, such an arrangement directs hot combustion products more fully around the coil tube circumference thereby increasing the heating efficiency. The cord or band also prevents direct leakage of combustion gases between adjacent coil windings that may not be perfectly formed and have gaps between the windings.

In order to facilitate the installation of the unit for a through-the-wall air supply and exhaust system, the heating system features a mounting unit for the subunit housing. The mounting unit has 1) a mounting panel with a thimble cut-out, 2) a thimble attached at right angles to the panel and cooperating with the thimble cut-out to receive an exhaust flue such as a vent pipe or conduit, and 3) a perpendicular sidewall flange extending outward from the mounting panel in a direction opposite the thimble and forming a frame that receives a portion of the subunit housing. The frame not only serves to support the subunit housing but also maintains the exhaust pipe in spaced-apart, coaxial alignment with the thimble to form a passage that allows combustion air to flow between the exterior of the exhaust pipe and the interior of the thimble through the thimble cutout and into the subunit housing. Such an arrangement has the advantage of allowing quick and easy installation of the subunit housing to provide a sealed combustion air and exhaust system.

The exhaust pipe and input combustion-air conduits feature vent embodiments that are designed to prevent exposure to interfering elements such as wind, rain, snow and debris including birds, insects and other plant and animal life. When a coaxial inner exhaust pipe and outer combustion air conduit are used, the vent comprises a spacer and a diagonally cut exhaust pipe with the maximum length at the upper most elevation. The spacer consists of a band, typically a flat elongate piece of sheet metal, that is formed into radial spokes that are joined one to the next by alternating interior and exterior annular surfaces. In addition, the vent device can be designed to maintain a cool outer surface especially when the exhaust pipe is at ground level or likely to cause harm or damage from contact with the hot surface. To this end, a rectangular or square exhaust termination is used with deflector tabs and a spaced-apart rectangular cover. A second embodiment uses a cylinder attached to the combustion-air conduit at one end and has an inner plate toward the other end with a circular hole at its center for receiving the terminal end of the exhaust pipe. Apertures in the cylinder between the connection to the combustion-air conduit and the inner plate provide for the entry of combustion air while apertures between the inner plate and the end of the cylinder provide for the entry of outdoor air to dilute and cool the hot exhaust products. A cylinder end cap prevents inadvertent contact with the exhaust pipe and a circular hole in the end cap serves as an exit passage for the cool and diluted exhaust products.

The output heat-exchange unit is placed in a second subunit housing. The second subunit housing can also contain an air conditioning unit having an appropriately connected evaporator, compressor, and condenser. The subunit housing is divided into three separate chambers to provide for an outdoor air handling system and an indoor air handling system. The outdoor air handling system has a single chamber containing the air conditioner compressor, condenser coil and fan components. The indoor air-handling system uses the remaining two chambers which are, respectively, the output heat-exchange unit chamber and the air conditioning evaporator coil chamber. A suitable air handling unit such as a blower connects the two indoor chambers and serves as a common air handling unit for both the air conditioning evaporator and the air-heating (output) heat exchanger. The output heat exchange unit chamber can also house a pump that circulates hot liquid to and from the output heat exchanger.

The foregoing and other advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

BRIEF DESCRIPTION OF THE DRAWINGS

FIG. 6A illustrates the flow pattern when the room air heating requirement can be provided by the dynamic thermal stabilizer alone.

FIG. 6B illustrates pump operation and flow when the input heat exchanger is activated to provide additional hot liquid for room air heating.

FIG. 6C illustrates the pump operation and flow diagram when no room air heating is provided but supplemental liquid heating is required for a hot liquid draw.

FIG. 9A is an embodiment comprising a shroud that is screwed onto the input heat exchange coil.

FIG. 9B is another embodiment similar to FIG. 9A in which the shroud is formed as two pieces with mating flanges for securing the two pieces around the exchange coil.

FIG. 9C is yet another embodiment of the heat exchange coil in which a band is wrapped around the input coil turns so as to cover the finned coil where individual coil turns contact or are in close proximity to each other.

FIG. 16A is a graph of the actual performance of the 15 gallon dynamic thermal stabilizer during one complete burner cycle with the room-air fan operating continuously in maximum space-heating mode showing temperatures (°F., vertical axis) versus elapsed time (minutes; horizontal axis) for various components (from top to bottom: 1) room-air coil input liquid, 2) input heat exchanger input liquid, 3) dynamic thermal stabilizer thermostat sensor, and 4) room-air coil output liquid).

FIG. 16B is a graph of the actual performance of the dynamic thermal stabilizer for a twenty minute shower showing temperatures (°F., vertical axis) versus elapsed time (minutes; vertical axis) for various components (from top to bottom at 5 minutes elapsed time: 1) input heat exchange output liquid, 2) input heat exchanger input liquid, 3) hot-water mixing valve output liquid, and 4) output heat-exchanger cutout sensor).

Figure 1:
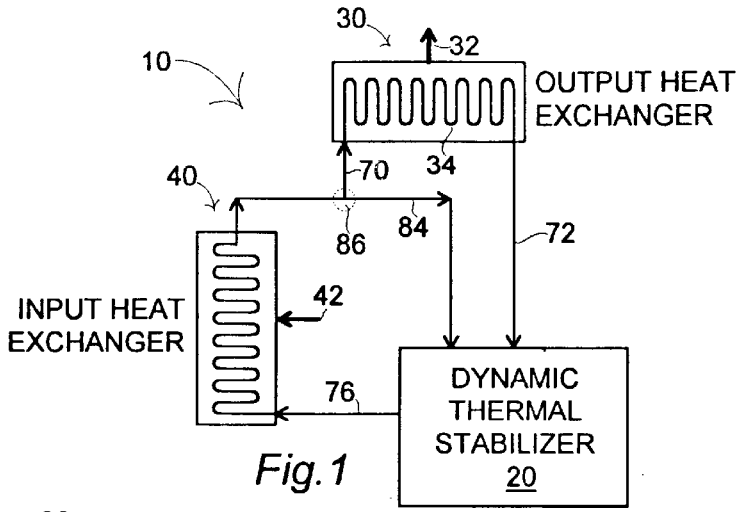
FIG. 1 is a schematic diagram of the invention illustrating its major components and flow patterns, that is, the dynamic thermal stabilizer, the input heat exchange unit, and the output heat exchange unit with the dynamic thermal stabilizer receiving liquid from both the input heat exchange unit and the output heat exchange unit.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has been herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION OF THE INVENTION AND BEST MODE FOR CARRYING OUT THE PREFERRED EMBODIMENT

FIG. 1 is a schematic view of the invention illustrating the basic components and liquid flow of a heating system that is generally denoted by the numeral 10. The heating system has a dynamic thermal stabilizer 20, an input heat exchange unit 40, and an output heat exchange unit 30 interconnected to circulate a liquid through each of these components. The dynamic thermal stabilizer 20 is connected to receive liquid from input heat exchange unit 40 by means of conduit 84. The dynamic thermal stabilizer 20 is also connected to receive fluid from the output heat exchange unit 30 by means of conduit 72. The output heat exchange unit 30 is connected to be receive fluid from the input heat exchange unit 40 by means of conduit 70, tee connection 86, and conduit 84. The output heat exchange unit 30 provides heat to a heat sink 32 such as cold air from a room air return. The input heat exchange unit 40 is connected to receive liquid from the dynamic thermal stabilizer 20 through conduit 76. The liquid is heated in the input heat exchanger 40 by means of a heat source 42.

A key feature of the present invention is the dynamic thermal stabilizer 20 that receives, mixes, stores and delivers thermal energy in a fashion akin to the use of a fly wheel in mechanical devices. The dynamic thermal stabilizer 20 has the advantage of allowing the storage of extra thermal energy during the operation of the input exchange unit 40 and releases such energy both with and without operation of the input heat exchange unit 40 to meet heating demands of the heating system.

The dynamic thermal stabilizer 20 also has the advantage of allowing for greater heat transfer efficiencies and longer mechanical part life by affording less frequent cycling of the input heat exchange unit 40 thereby reducing wear on the system as a result of corrosion and part fatigue due to temperature cycling in the input heat exchange unit as well as wear on associated control parts such as fuel valves, thermal sensors, ignitors, ignition sensors, air handlers, pumps, expansion tanks, and other mechanical and electrical components. The dynamic thermal stabilizer 20 also provides a more uniform and constant heat source over greater periods of time for heating purposes such as for heating water, typically potable water, or room air or both. In the present invention, the dynamic thermal stabilizer 20 is the tempering unit of the system serving initially to deliver room air heating and a hot liquid draw when an open system is used. It is only after the heat supply in the dynamic thermal stabilizer is depleted by either or both of these uses that the input heat exchanger is called into operation. This is quite unlike prior art designs where the input heat exchange unit was the focal point of heat demand and was called into use as soon as and whenever heat was required by the output heat exchanger.

The use of dynamic thermal stabilizer 20 and a separate input heat exchange unit 40 allows for a smaller component configuration than is otherwise needed when only an input heat exchange unit 40 is used (e.g., instantaneous heating) or when heat input is applied directly to a liquid tank (e.g., conventional water tank heating).

The dynamic thermal stabilizer 20 also receives and stores the extra amount of heat generated by the input heat exchange unit 40 that is not removed by the output heat exchange unit 30. This allows the input heat exchanger 40 to be sized for a larger input rate than the output heat exchanger 40 can remove. Alternatively, different sizes of output heat exchange unit 30 can be used with one fixed size of input heat exchange unit 40. In addition, the one fixed size of input heat exchange unit 40 allows the use of two or more output heat exchange units 30 as for zone heating. Because of the stored heat in the dynamic thermal stabilizer 20, simpler and slower responding control systems than those used in instantaneous heaters may be used.

As will be discussed and further illustrated, the basic design functions shown in FIG. 1 can be achieved with a wide variety of components and component interconnections. The overall heating system contemplates a wide variety of input and output heat exchange devices, tanks, heat exchange coils, flow control devices including flow restrictors, "tees", valves including proportioning valves, check valves, flow restriction valves, three-way valves, etc., piping of various size, circulating devices such as pumps and siphons that are routinely used in conventional heating and cooling systems and whose use and interconnection are within the purview of those skilled in the art.

The heat exchange functions and associated liquid flow patterns of this invention can be carried out with either a closed or open liquid system. In a closed system, a liquid circulates in a closed-loop fashion with essentially no liquid being added or withdrawn from the system. The closed loop-liquid is selected to have good heat transfer characteristics such as found in but not limited to a glycol-water mixture. In addition, anti-corrosion additives are typically added to the liquid to further enhance the life of the various system components.

In an open-loop system, liquid is periodically added to and withdrawn, typically as hot liquid, from the system. In such instances, the liquid is typically water and especially potable water as provided typically by a pressurized cold water supply such as from a municipal or well-water system. Although it is not necessary that the liquid be potable water or even water, the invention is typically used with potable water systems to provide hot water for various domestic uses, such as washing clothes, bathing, and drinking.

FIGS. 1–5 illustrate various alternative embodiments of the invention showing variations in output and input heat exchange units, 30 and 40, respectively, and various flow paths for interconnecting these units to the dynamic thermal stabilizer 20. Although, as noted, a wide variety of heating system components such as circulating devices (e.g., pumps and thermal syphons), valves (e.g., check valves, proportioning, flow control, and three-way valves) and piping details (e.g., variations in size, flow restriction, etc.) are contemplated by this invention, it is to be realized that 1) the input heat exchange unit 40 must be connected to receive liquid from the dynamic thermal stabilizer 20, 2) the dynamic thermal stabilizer 20 must be connected to receive fluid from the input heat exchange unit 40 and the output heat exchange unit 30, and 3) the output heat exchange unit 30 must be connected to receive liquid from the input exchange unit 30. It is also to be realized that it is not necessary to maintain all connections and all flows at all times within the system and that a single conduit can function in more than one capacity at the same time, e.g., as a common flow conduit carrying flows from two separate units such as the input heat exchange unit 40 and the output heat exchange unit 30 to a third unit such as the dynamic thermal stabilizer 20, or in different capacities at different times, e.g., carrying liquid from the dynamic thermal stabilizer 20 to the output heat exchange unit 30 at one time and carrying liquid to the dynamic thermal stabilizer 20 from the input heat exchanger at another time.

Figure 2:
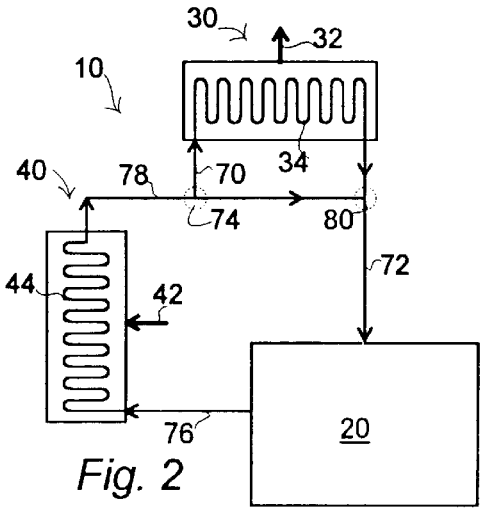
FIG. 2 is a schematic illustration of another embodiment of the invention illustrating the use of a single conduit to carry liquid from the input heat exchanger and the output heat exchanger to the dynamic thermal stabilizer.

In FIG. 2, output heat exchange unit 30 receives fluid from the input heat exchange unit 40 by means of conduit 78, the tee connection 74, and conduit 70. The dynamic thermal stabilizer 20 receives liquid from 1) the output heat exchange unit 30 by means of connector tee 80 and conduit 72 and 2) the input heat exchange unit 40 by means of conduit 78, tee 74, tee 80, and conduit 72. For both flows, a portion of conduit 72 is used to deliver liquid from both the input and output heat exchangers 40 and 30, respectively. In FIGS. 1–5, liquid flows from the dynamic thermal stabilizer 20 through the input heat exchanger 40. In these configurations, it is to be realized that the input heat exchanger need not be operative, i.e., receiving heat input 42 (or 47 in FIG. 4). The input heat-exchange unit 40 does not activate until the temperature level of the liquid in the dynamic stabilizing unit drops below a preselected temperature.

Figure 3:
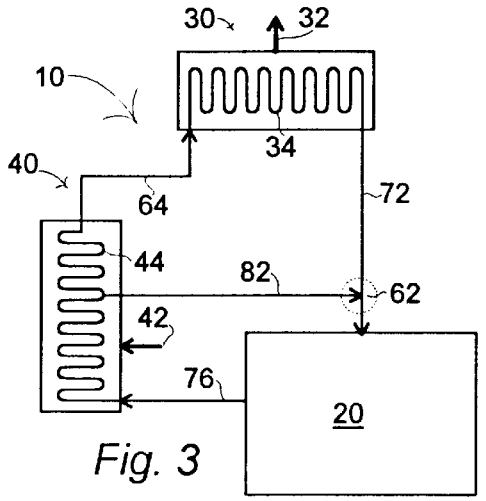
FIG. 3 is a schematic drawing of another embodiment of the invention illustrating the use of separate liquid outputs from the input heat exchange unit.

FIG. 3 shows the dynamic thermal stabilizer 20 receiving liquid from the input heat exchange unit 40 via conduit 82, tee 62 and a portion of conduit 72 and the output heat exchange unit 30 via conduit 72. As in FIG. 2, a portion of conduit 72 is used to deliver liquid from both the input and output heat exchangers 40 and 30, respectively. FIG. 3 also illustrates the use of separate outputs from the input heat exchange unit 40. Thus, the dynamic thermal stabilizer 20 receives liquid from operational input heat exchange unit 40 at a somewhat lower temperature through conduit 82, connection 62 and a portion of conduit 72 while output heat exchange unit 30 receives liquid from the input heat exchange unit 40 via conduit 64 at somewhat higher temperature. The use of multiple take off points from operational input heat exchange unit 40 provides liquid at different temperatures to the dynamic thermal stabilizer unit 20 and the output heat exchange means 30.

Figure 4:
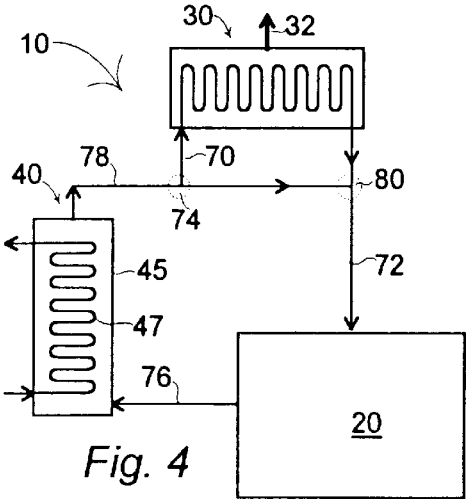
FIG. 4 is a schematic drawing illustrating another embodiment of the invention, in which heat is provided to the input heat exchange unit by means of a heat exchange coil.

FIG. 4 illustrates a different heat exchange configuration for the input heat exchange unit 40. In this configuration, liquid from the dynamic thermal stabilizer 20 is received into a tank 45 of the input heat-exchange unit 40. Here the liquid is heated by heat exchange coil 47 containing a hot second fluid such as steam or other hot liquid that transfers heat to the liquid circulating through tank 45. The liquid in tank 45 could also be heated with an electrical resistance heating element. After heating, liquid passes to the output heat exchange means 30 or to the dynamic thermal stabilizer 20 or to both at the same time.

Figure 5:
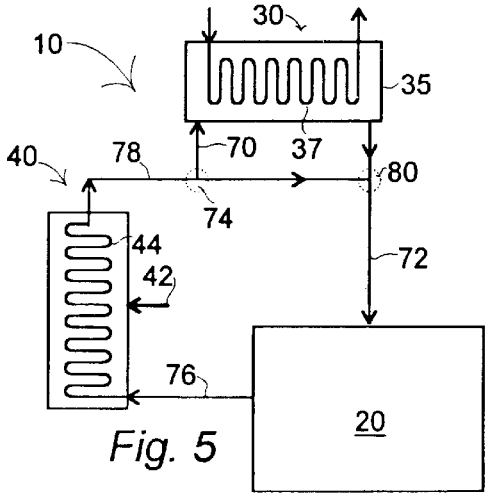
FIG. 5 is a schematic drawing of another embodiment of the invention in which output heat is removed from the circulating liquid by means of a heat exchanger with a second fluid.

FIG. 5 illustrates a different configuration for the output heat-exchange unit 30. In this configuration, hot liquid from the input heat exchange unit 40 is received into a tank 35 of output heat exchange unit 30 via conduit 78, tee 74 and conduit 70. Here the hot liquid in tank 35 heats a second cooler fluid circulating in heat exchanger 37. The liquid in tank 35 returns to the dynamic thermal stabilizer 20 by means of conduit 72.

A wide variety of component and flow combinations and permutations can be used with the current invention of which some are shown in FIGS. 1–5. Many others will be readily apparent to those skilled in the art. In all of these arrangements, one of the key features is the use of the dynamic thermal stabilizer 20 which receives fluid from both an input heat exchange unit 40 and an output heat exchange unit 30. As noted previously, it is not necessary to operate the input heat exchange unit 40 for all heating needs since the invention contemplates the circulation of fluid through the input heat exchange means 40 without heat input 42 to the input heat exchange unit 40. That is, under certain circumstances, it is not necessary to activate heat source 42 (FIGS. 1–3 and FIG. 5) or heat source 47 (FIG. 4). In such instances, the stored thermal energy in the liquid contained in the dynamic thermal stabilizer is sufficient to provide initial heat output at output heat exchange unit 30 (32 in FIGS. 1–4 or 37 in FIG. 5) or in the form of the heated liquid itself when an open-system configuration is used. It is only as the liquid from the dynamic thermal stabilizer 20 is circulated or withdrawn and drops below a certain temperature that the input heat exchange unit heat source 42 (or 47 in FIG. 4) is activated to heat further the system liquid.

For open systems, it is possible to draw hot liquid from the dynamic thermal stabilizer 20 without passing liquid through the output heat exchange unit 30 or operating the input heat exchanger 40. In such a situation, an initial draw of hot water is taken directly from the dynamic thermal stabilizer 20. As the draw continues and the temperature of the dynamic thermal stabilizer 20 drops below a predetermined temperature, the liquid in the dynamic thermal stabilizer 20 is heated by the input heat exchange means 40 and returned directly to the dynamic thermal stabilizer 20. It is to be realized that in this situation, it is not necessary that there be heat output 32 from the output heat exchange unit 30 although such an arrangement is possible depending on the overall heat output needs and/or component arrangement of the system.

Figure 6A:
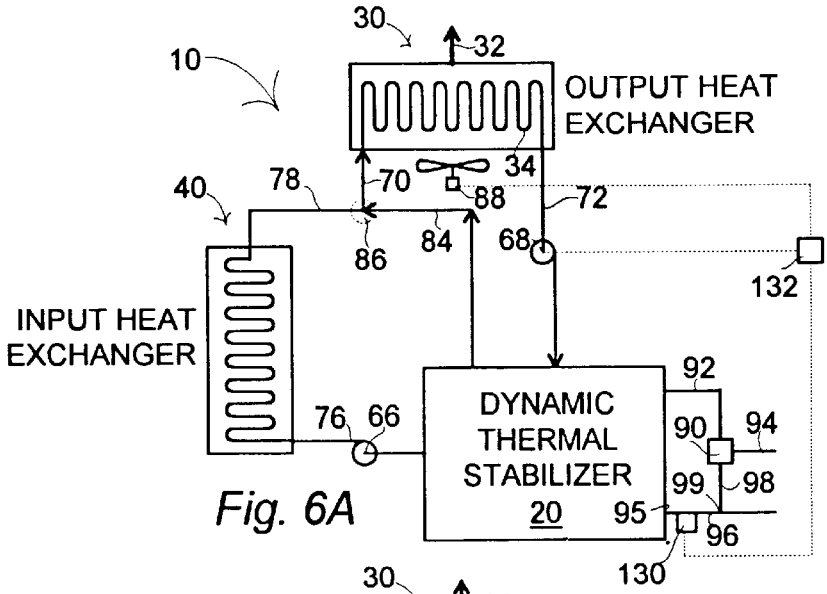
FIGS. 6A–C are schematic drawings illustrating a specific embodiment of the invention depicting an open system configuration using two pumps and a tee to provide requisite flow patterns.
Figure 6B:
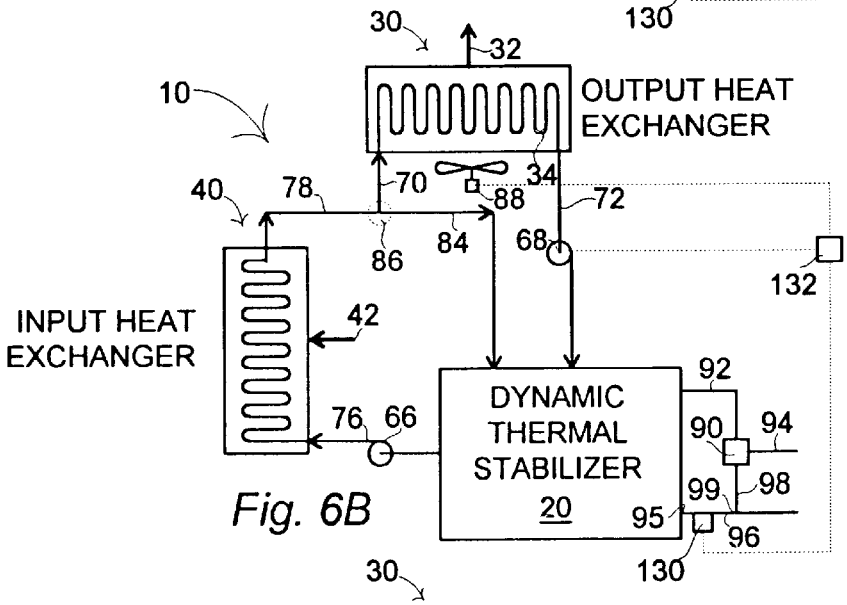
Figure 6C:
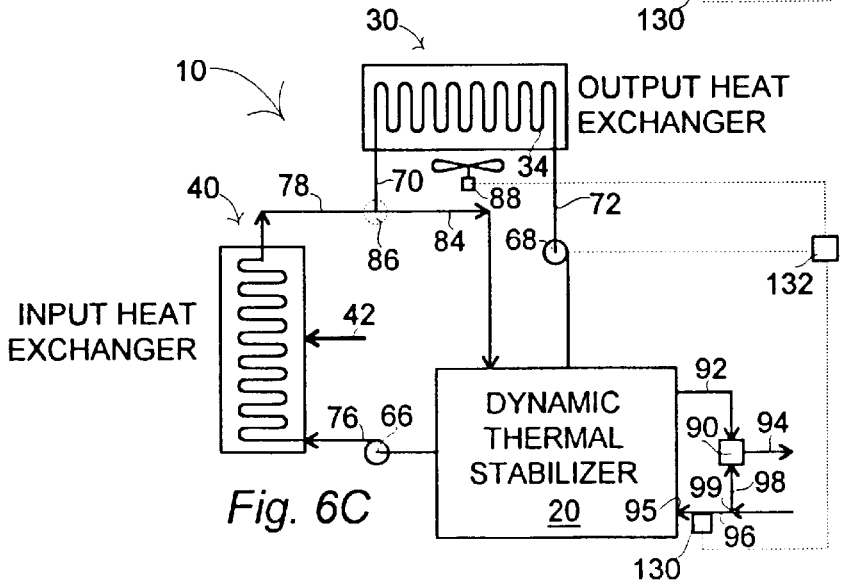

To illustrate further the operation of the invention, a more detailed flow and connection scheme is illustrated in FIGS. 6A–C for an open loop liquid system. FIGS. 6A–C illustrate the basic system configuration set forth in FIGS. 1–5, that is, the receipt of liquid from both the input heat exchange unit 40 and output heat exchange unit 30 by the dynamic thermal stabilizer 20, and further illustrates the use of a piping configuration in which passage through the input heat exchange unit 40 is avoided when the liquid in the dynamic thermal stabilizer 20 is of sufficient temperature to provide the required heat output at the output heat exchanger 30 or a heated liquid of required temperature at output 92 or 94.

A key feature in FIGS. 6A–C is the use of tee 86 that allows conduit 84 to serve as both an input flow and an output flow to and from the dynamic thermal stabilizer 20. To achieve a valveless configuration, two pumps are used, a first pump 66 located in line (conduit) 76 between the dynamic thermal stabilizer 20 and input heat exchange unit 40 and a second pump 68 located in line (conduit) 72 between the output heat exchange unit 30 and the dynamic thermal stabilizer 20. Pumps 66 and 68 operate independently of each other and can be of such design so as to serve also as check valves to prevent flow in the opposite direction when the pump is not operating. Both, either one, or none of these pumps are selectively operated to meet the heating requirements of the overall system. Separate check valves can be added to the circuits as is known in the art.

The configuration in FIGS. 6A–C allows the output heat exchange unit 30 to be connected into the heating system 10 to receive selectively heated liquid directly from the input heat exchange unit 40 or directly from the dynamic thermal stabilizer 20. That is, when only pump 68 is operating, output heat exchange unit 30 receives hot liquid directly from the dynamic thermal stabilizer 20 by way of conduit 84, tee 86, and conduit 70. Pump 66 is off and may serve as a check valve to prevent circulation of the liquid through input heat exchange unit 40 (FIG. 6A). Although a check valve in line 76 is not essential and a small amount of liquid may flow through input unit 40, a separate check valve or as part of pump 66 is preferably used. When both pumps 68 and 66 are operating, the output heat exchange unit 30 receives hot liquid directly from input heat exchange unit 40 by way of conduit 84, tee 86, and conduit 70 (FIG. 6B) for an extra heat boost.

FIG. 6A illustrates the flow arrangement in which heat output 32 is desired from the output heat exchanger 30 and there is sufficient hot liquid in the dynamic thermal stabilizer 20 to provide such heat output. In this configuration, hot liquid from the dynamic thermal stabilizer 20 passes through conduit 84 to the tee fitting 86 from which it passes to conduit 70 and into the output heat exchanger 34 of the output heat exchange unit 30. A fan 88 circulates cold return air over the output coil 34 to provide room air output heating 32. The cooled liquid in exchanger 34 is pumped by pump 68 from the output heat exchanger 30 to the dynamic input stabilizer 20 through conduit 72. In this instance, only pump 68 is activated and provides the necessary circulation through the output heat exchange unit 30 to afford heating of room air via heat exchanger 34 and air circulating means 88. When operating in this fashion, circulating pump 66 is off and may serve as a check valve to prevent back circulation of liquid through the input heat exchange means 40. In this mode of operation, no heat input 42 is delivered to the input heat exchanger 40.

In the second mode of operation illustrated in FIG. 6B, the temperature (heat content) of the liquid in the dynamic thermal stabilizer 20 has dropped to the point that it is no longer sufficient to provide sufficient output heat 32 for room air heating. In this situation, both pump 66 and pump 68 are activated. In addition, the heat source 42 is also activated to provide heat to the liquid circulating in input heat exchange unit 40. In this mode of operation, circulating pump 66 draws liquid from the dynamic thermal stabilizer 20 and circulates it through the input heat exchange means 40 where it acquires heat from heat source 42 after which it circulates through conduit 78, tee 86 and conduit 84 and is returned to dynamic thermal stabilizer 20 to mix with and heat the liquid found therein. Circulating pump 68 is also in operation and draws a portion of the hot liquid from conduit 78 at tee fitting 86 through conduit 70. This hot fluid is delivered to the heat exchanger 34 where return air circulating over exchanger 34 by means of blower 88 is heated to provide hot air to the living space. By taking the hot liquid directly from the input heat exchange unit 40, a boost in air heating 32 is achieved by using the higher temperature liquid as it comes directly from the input heat exchange unit 40. Actual results are graphically shown in FIG. 16A.

Figure 16A:
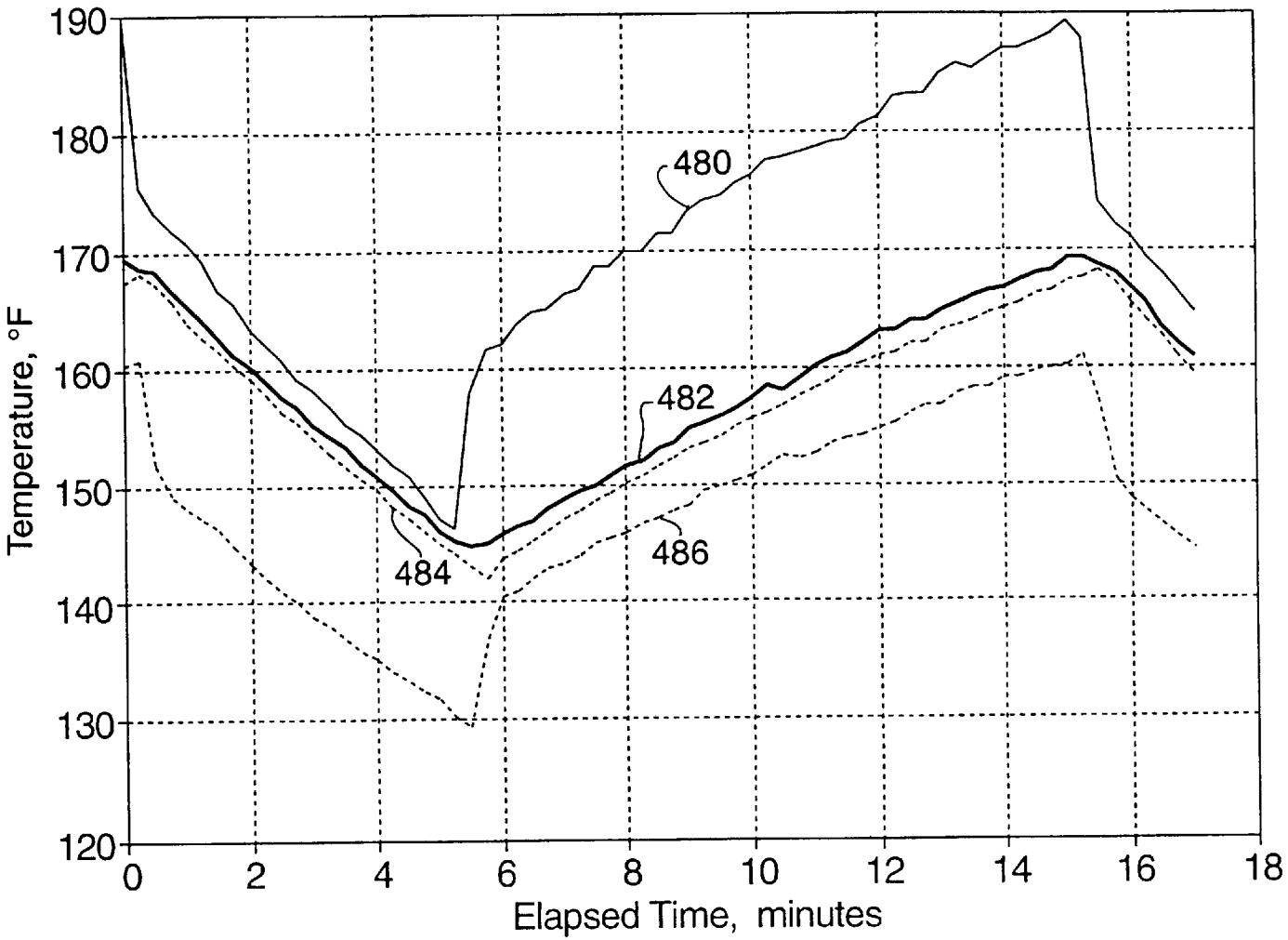
FIGS. 16A and 16B show the actual performance of a 15 gallon dynamic thermal stabilizer with a 15° F. degree differential tank thermostat, a 170° F. maximum tank temperature, a cold water input temperature of 60° F., and room air temperature of 70° F. The output heat exchange unit is rated at 43,000 BTU/hr, with a thermal switch cutout after 30 seconds of cold water draw into the dynamic thermal stabilizer unit from the cold water source. The input heat exchanger is rated at 85,000 BTU/hr input.

FIG. 16A is a plot of temperatures during one complete burner cycle while the output coil 34 was operating continuously in the maximum space-heating mode. The room-air coil inlet water temperature is shown as curve 480, the input heat-exchange input liquid temperature as curve 482, the dynamic thermal stabilizer sensor temperature (at 150 in FIGS. 7 and 10) as curve 484, and the room-air coil output temperature as curve 486. The data plot begins just as the burner 108 shut off after an identical heatup cycle. The heat output of the output coil 34 was measured as 40,700 Btu/hr at 160° F. inlet water temperature (at 2.5 minutes), and increased to 53,900 Btu/hr when the inlet water temperature reached 180° F. (at 11.75 minutes). The curves show that the room-air coil inlet water temperature increases about 15° F. when the burner 108 is firing, because a portion of the input heat exchanger outlet water is taken directly to the room-air coil 34. This "temperature boost" feature increases the effective space heating output of the coil 34. Another feature was that the water flow rate through the coil 34 was 4.24 gpm when the input heat-exchanger pump 66 was off, and only decreased slightly to 4.16 gpm when the pump 66 was running. The flue gas outlet temperature was only 283° F. when the input heat-exchanger inlet water temperature approached 160° F. at 10.5 minutes. The nominal dynamic thermal stabilizer "setpoint" temperature achieved with this particular thermostat is 170° F., as observed by the input heat-exchanger inlet water temperature curve 482 as the burner 108 shuts off. Therefore, a thermostat with a 10° F. lower operating range could be used which would open at 150° F. and close at 135° F.

A third mode of operation is illustrated in FIG. 6C. Initially a draw of hot liquid is taken at hot liquid output 92.

To prevent bums when the hot liquid is used for domestic purposes, an anti-scald mixing device 90 can be provided in the system to provide water at a lower predetermined temperature, for example, 120° F. at output 94. Typically the mixing valve 90 receives hot water from the hot water output 92 and cold water from a cold water source 98, mixes the hot and cold flows to provide a heated water output 94 at a preselected and adjustable temperature. As shown, the anti-scald valve 90 is joined to the cold water source 96 by means of a tee 99 and conduit 98.

Initially the hot water draw is provided as a result of the pressurized cold water source 96. As hot water is drawn from the dynamic thermal stabilizer 20 and the hot water is replaced by cold water from the cold water source 96, the temperature in the dynamic thermal stabilizer 20 drops to a predetermined temperature. At this point, pump 66 is activated as well as the input heat source 42 to the input heat exchange unit 40. Pump 66 circulates water from the dynamic thermal stabilizer 20 through the input heat exchanger 40 which is returned to the dynamic thermal stabilizer 20 through conduit 78, tee 86 and conduit 84. As illustrated, pump 68 is inactive and no room air heating is provided. This configuration is typical during summer months when no room air heating is required. If, in fact, room heating is desired, it is possible to activate pump 68 as shown in FIG. 6B. However during long sustained draws of hot water from the dynamic thermal stabilizer, it has been found practical to turn off pump 68, especially at low cold-water temperatures. With the output heat exchange unit 30 off (pump 68 inactive), a fifteen-gallon dynamic thermal stabilizer 20 with an initial fluid temperature of 150° F. will provide a twenty minute shower draw with an 85,000 BTU per hour input heat exchange unit 40 while only experiencing a 5° F. room air temperature drop. Actual results are graphically depicted in FIG. 16B.

Figure 10:
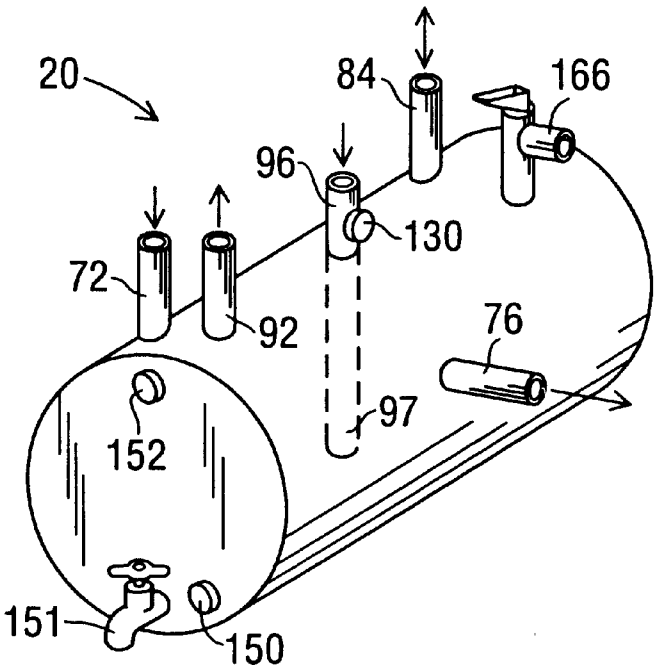
FIG. 10 is a pictorial representation of the dynamic thermal stabilizer showing the input and output piping connections.
Figure 16B:
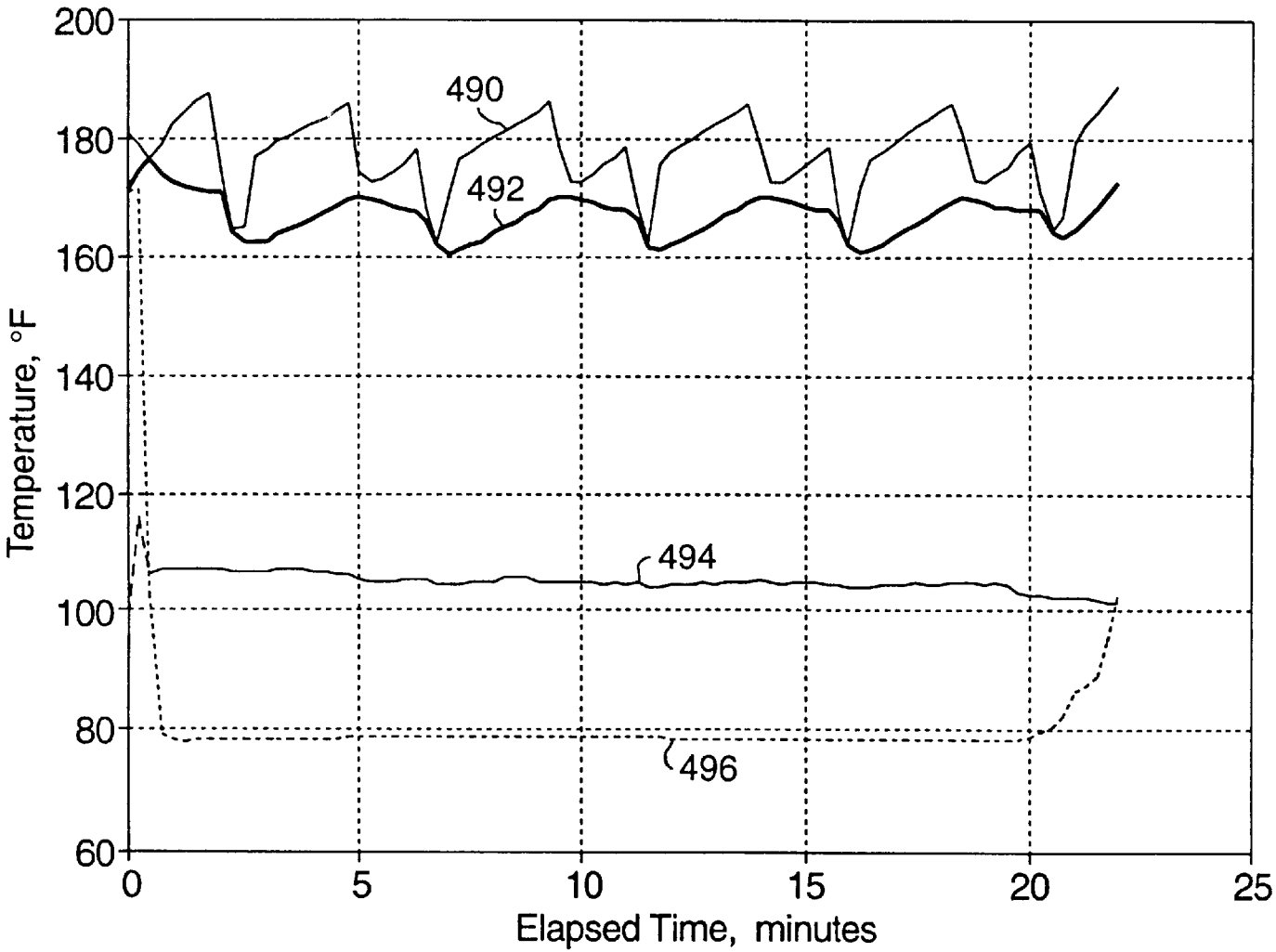
Figure 18:
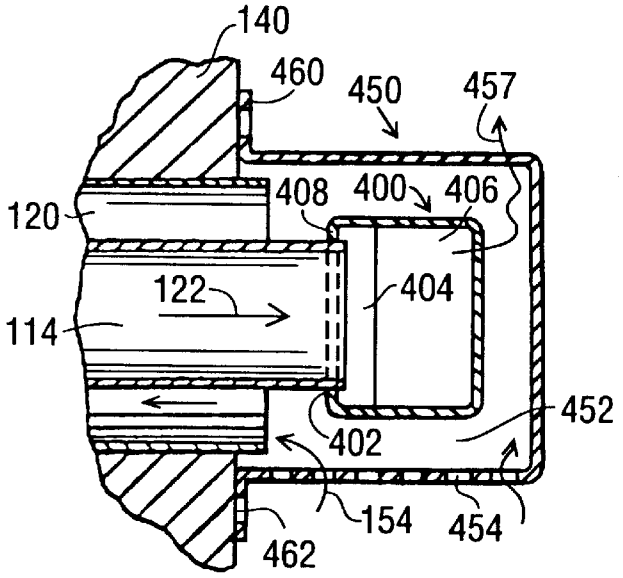
FIG. 18 is a cross-sectional view of the eductor embodiment shown in FIG. 17 along line 18—18.
Figure 17:
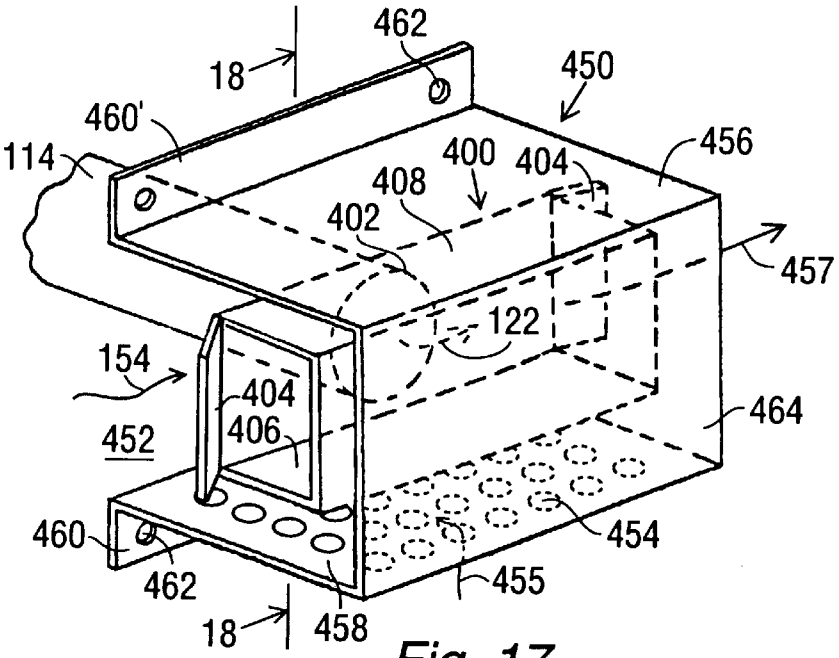
FIG. 17 is a perspective view of an embodiment of an eductor terminal for exhaust products from the input heat exchanger designed to cool the outer exposed surfaces.

FIG. 16B is a plot of temperatures taken during a 20-minute shower draw, which is twice as long as an average shower according to the American Society of Heating, Refrigerating and Air-Conditioning Engineers (ASHRAE) guidelines for hot water usage. The input heat-exchanger output-water temperature is shown as curve 490, the input heat-exchanger input-water temperature as curve 492, the mixed shower-water temperature as curve 494, and the output heat-exchanger cutout-sensor temperature (at 130 in FIGS. 6C, 7 and 10) as curve 496. The domestic hot water temperature drawn from the compact fluid heater was set at 120° F. with a Sparko anti-scald mixing valve. The shower draw was maintained at 2.5 gpm with a second mixing valve set at 105° F. The 2.5 gpm draw rate was kept constant by maintaining the water pressure at 40 psig using a flow orifice in the outlet pipe having a diameter of 0.148 inch. The input heat-exchanger outlet curve 490 shows that the burner cycled four times during the draw. The main reason for the more frequent cycling is believed to be due to the cold-water dip tube 97 (FIG. 10). The dip tube 97 introduces the cold makeup water to the bottom of the dynamic thermal stabilizer 20 and, as a result, the tank thermostat 150 near the bottom of the tank more quickly responds to start the burner. Once the pump 66 and burner 108 turn on, the water in the tank becomes stirred and mixed so that the thermostat more quickly reaches its 160° F. setpoint. The responsiveness of thermostat 150 to hot water usage can be reduced and less cycling obtained by reducing the length of or eliminating dip tube 97. Some smaller increases in input heat-exchanger outlet temperatures are shown between each of these burner cycles, but there are believed to be due to some heat soak from the combustion chamber while the pump is off. Another important temperature curve is the cold-water pipe inlet temperature curve 496. A thermocouple was located on the copper cold-water pipe just about 3 inches before it enters the top of the tank, and where the thermal switch 130 (FIGS. 6C, 7 and 10) could be located to interrupt the operation of the space heater during large hot water draws. Without any water draw, this cold-water pipe remained very close to the water temperatures at the top of the dynamic thermal stabilizer 20. However, when a hot water draw begins, the cold water pipe temperature quickly drops. Therefore, if a thermal switch were used with a cutout/cut-in temperature of 100° F., for example, the space heating coil would be shut off in less than a minute after a significant hot water draw begins. At the other end of the cycle, when the hot water draw stops, the heating coil could start up again after about two minutes because of heat soak up the copper pipe and expansion of the water being heated. The input heat-exchanger inlet temperature curve 492 indicates that the setpoint temperature of the dynamic thermal stabilizer thermostat 150 (FIGS. 7 and 10) could be lowered by about 10° F.

Figure 7:
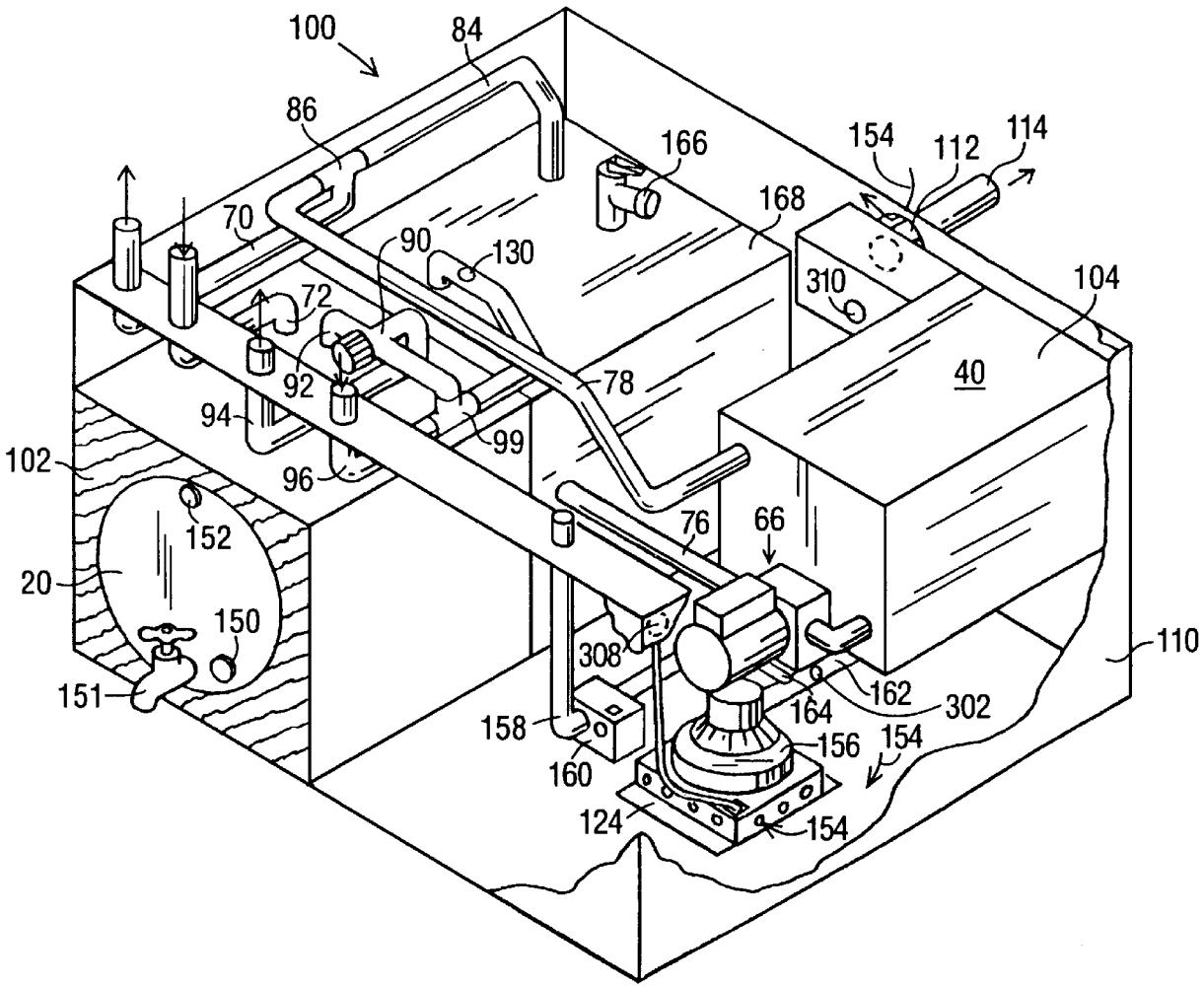
FIG. 7 is a partially cut away perspective drawing illustrating the subunit housing containing the dynamic thermal stabilizer and input heat exchanger along with associated piping and pump components.

FIG. 7 illustrates a subunit housing 110 containing the dynamic thermal stabilizer 20 and the input heat-exchange unit 40. Generally the dynamic thermal stabilizer 20 comprises a liquid storage container with suitable inlet and outlet connections. The liquid storage container is of conventional, hot-water tank design such as of glass-lined or stainless-steel construction. Generally a fifteen-gallon tank is sufficient to deliver a twenty minute shower at an outdoor temperature of 5° F. with an 85,000 BTU per hour input heat exchange unit, a 43,000 BTU per hour output heat exchange unit and an initial dynamic thermal stabilizer tank temperature of 150° F. A fifteen-gallon tank requires about three burner cycles per hour with a 10–15° F. tank differential temperature. Smaller tanks down to about 5 gallons can be used but with increased cycle frequency.

As shown in FIG. 10, the dynamic thermal stabilizer 20 has a number of input and output connections. Conduit 72 is a return line for receiving fluid from the output heat exchanger 30. Conduit 84 is an input and output conduit for receiving hot fluid from the input heat exchange unit 40 or for supplying hot fluid to the output heat exchange unit 30 (FIGS. 6A–C). Typically, conduit 84 is connected to the dynamic thermal stabilizer 20 somewhat below the uppermost portion of the dynamic thermal stabilizer 20 to avoid accumulation of non-condensible gases in the output heat exchange unit, when only the output heat exchanger 30 is operating, and especially when the output heat-exchange unit is located at the highest elevation in the system. Conduit 76 is an output conduit for output of liquid to the input heat exchange unit 40. Conduit 96 is an input conduit for cold water from a cold water source while conduit 92 is a direct hot water output. Conduit 96 typically extends to near the bottom of the dynamic thermal stabilizer 20 to introduce the cold makeup water where the tank thermostat (sensor) 150 will be activated more quickly. The other liquid input and output conduits on the dynamic thermal stabilizer 20 are arranged to provide good separation, liquid mixing, and thermal stabilization of the incoming and outgoing liquids, especially when the pumps are operating.

Retuning to FIG. 7, it is noted that conduit 70 is attached to tee 86 in a downward position. By locating conduit 70 below conduit 84 and positioning the inlet conduit 84 for the output heat exchanger 40 slightly below the uppermost portion of the tank (FIG. 10), passage of non-condensible gas bubbles from stabilizer 20 to the output heat-exchange unit 30 is virtually eliminated. Any non-condensible gas bubbles that may collect in the dynamic thermal stabilizer 20 leave via conduit 92 located at the uppermost portion of the dynamic thermal stabilizer 20 and are eliminated from the system through the hot-water outlet 94. The dynamic thermal stabilizer 20 also has a standard safety temperature and pressure relief valve 166 of conventional design. The dynamic thermal stabilizer 20 can also have a drain valve 151 located near the bottom of the tank. The various input and output conduits can be threaded, soldered brazed, or welded to the dynamic thermal stabilizer 20. The latter of these attachments form a more dependable water tight seal with the dynamic thermal stabilizer 20 especially when the dynamic thermal stabilizer is totally enclosed in insulation 102.

The insulating material 102 can be a glass fiber, rockwool, or other flexible material. However, dynamic thermal stabilizer 20 can also be enclosed in a solid form of insulation 102 such as foamed polyurethane. The dynamic thermal stabilizer 20 can be completely enclosed in the insulating material 102 or the insulating material can be formed in two or more sections that enclose the dynamic thermal stabilizer 20. When the dynamic thermal stabilizer 20 is enclosed in solid insulation 102, it is desirable to conform the shape of the solid insulation to at least two sides of the subunit housing. This has the advantage of allowing for quick positioning of the dynamic thermal stabilizer 20 in the subunit housing for alignment of the dynamic thermal stabilizer input and output fittings with the other components in the housing. Also it serves to stabilize and secure the dynamic thermal stabilizer 20 especially when the dynamic thermal stabilizer is essentially in the form of a round cylinder. A covering 168 is placed over the dynamic thermal stabilizer insulation 102 in the area that is near the input heat exchanger 40 to prevent excessive heating and possible damage to the insulating material 102.

The subunit housing 110 also contains the input heat exchange unit 40. The heat exchange unit 40 comprises a housing 104 and is further illustrated in FIG. 8. The liquid heating coil 106 comprises finned tubing, preferably of corrosion resistant material such as 304L stainless steel, 316L stainless steel, cupronickel, or all copper. The tubing is wound in a single-row helical coil such that the finned tips of adjacent turns are in contact with each other. Coil 106 has a cold fluid inlet 172 and a hot liquid outlet 174. It is contained within input heat exchanger housing 104 which is constructed of heat and corrosion resistant material. A burner 108 is mounted coaxially (194) at the center of the helical exchange coil 106 in a lower opening of the housing 104 to receive an air and gas mixture 170 from the combustion blower 156 through blower tube 162 (FIG. 7). The top of the input heat exchange unit 40 is insulated from the combustion products by refractory insulation 178. The bottom of the input heat exchange unit 40 is also insulated with insulating material 180.

Figure 8:
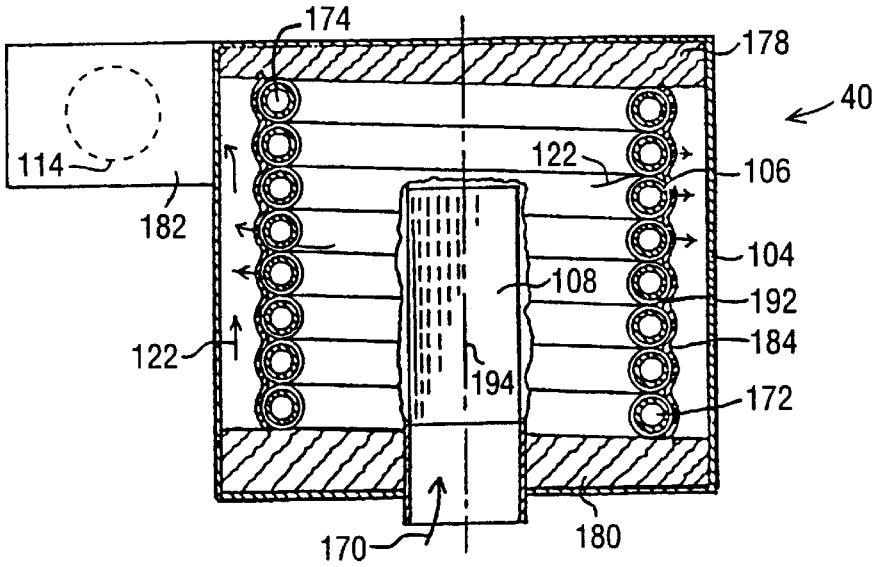
FIG. 8 is a cross-sectional view of an embodiment of the input heat exchange unit utilizing a gas burner with a helical finned tube heat exchange coil.

In operation and as shown in FIG. 8, an air and gas mixture 170 supplied by combustion blower 156 enters burner 108 and burns in the space between burner 108 and the input heat exchange coil 106. The hot combustion products flow between the fins 192 of the heat exchange coil 106 and into plenum 182 which directs the combustion products to flue (exhaust pipe or conduit) 114. Plenum 182 is not critical to the configuration and the combustion products can be vented directly to the exhaust pipe 114 from the input heat exchange housing 104.

Figure 9A:
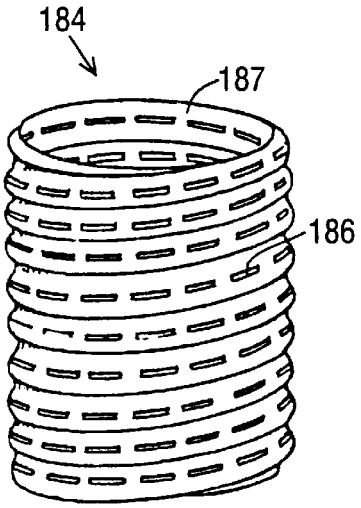
FIGS. 9A–C illustrate various combustion product deflection devices surrounding the outside of the finned tube heat exchange coil of FIG. 8 used to improve the heat exchange from the hot combustion products to the system liquid in the coil.

To further improve the combustion product heat exchange with the liquid passing through the finned heat-exchange coil 106, it is desirable to maintain the hot combustion products in contact with as much of the surface area of the exchange coil 106 and fins 192 as possible. Various embodiments for achieving this objective are shown in FIGS. 8 and 9A–C. As shown in FIGS. 8 and 9A, heat exchange coil 106 can be enclosed in an annular cylinder (shroud) 184. Apertures 186 are formed in shroud 184 to permit combustion products to exit. Preferably, the apertures 186 are formed to be in alignment with the outermost radial extension of the heat exchange coil 106, i.e., the outermost radial position from coaxial axis 194. This encourages the hot combustion products 122 to completely flow around the tube and fins of the heat exchange coil 104 and exit through apertures 186 at a point most distant from the center axis 194 of the heat exchange coil.

It is to be recognized that maintaining alignment of the apertures 186 with the outermost extremity of the heat exchange coil windings can be difficult as the coils tend to expand and spring apart and otherwise distort especially under hot combustion product conditions. To maintain the apertures of the annular cylinder 184 in alignment with the outermost portion of the windings of heat exchange coil 106, the annular cylinder 184 is formed with a helical grove 187 conforming with the radially outermost surface defined by the finned helical coil 106. The helical coil 106 is screwed into annular cylinder 184 which holds the windings of the coil in contact with each other and also provides the correct alignment of the apertures 186 with the outermost position of each coil winding so as to permit and afford the maximum contact of the hot combustion products 122 with heat exchange coil 106.

Figure 9B:
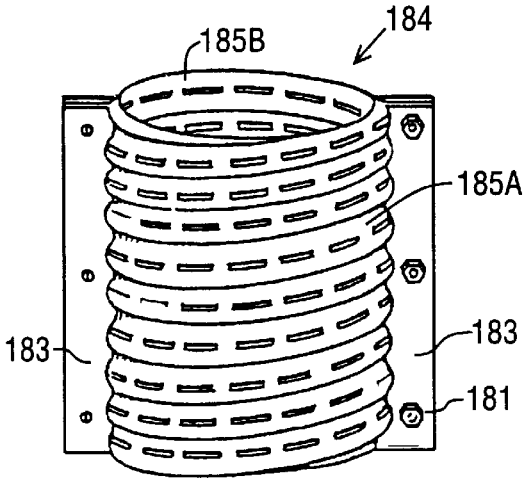
Figure 9C:
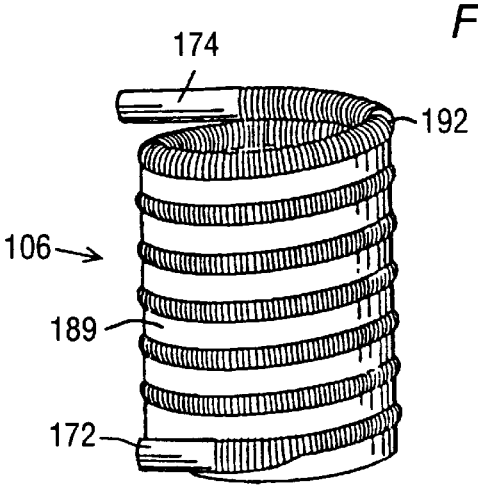

It is realized that it may not be convenient to wind and unwind the ends 172,174 of the input heat exchanger coil 106 in order to screw annular cylinder 184 into place. As shown in FIG. 9B, the shroud 184 can be formed as two hemi-cylindrical pieces 185A,185B with extending flanges 183 that can be joined together around coil 106 using suitable securing techniques including fasteners such as nuts and bolts 181. In another embodiment shown in FIG. 9C, a band 189, typically metal, or high-temperature ceramic fiber cord (not shown) can be helically wound around the coil at the point where the coil windings contact each other. When a band or cord winding is used, it is desirable to maintain the windings of the coil 106 in contact or close proximity with each other using wire or a similar securing device. A wire is typically passed through the interior of coil 106 with the ends of the wire twisted together on the exterior of the coil. Devices such as the annular cylinder 184, band 189, or cord have been found to increase the efficiency of the heat exchange coil 104 by about 5–15%.

Returning to FIG. 7, it is seen that burner gas is provided through inlet conduit 158 which is connected to gas control valve 160. Gas from the valve passes to and joins blower tube 162 at tee connection 164. The flow rate of the gas into the blower air is controlled by a fixed size orifice in the gas manifold (not shown) and the gas pressure maintained by the gas valve 160. The resulting pressurized and premixed gas/air mixture is then passed to burner 108 (FIG. 8).

Typically housing 110 is formed as an airtight unit with the various conduits being sealed to the unit using grommets of appropriate composition. An aperture 112 formed in the housing receives exhaust flue (conduit) 114 and also allows a fresh air supply 154 to enter into the sealed housing 110. Combustion air 154 is brought into the combustion air blower 156 through plenum 124 and mixed with the gas coming in at connection 164 to provide the appropriate air/gas mixture ratio for burner combustion. Housing 110 also contains the appropriate wiring, wiring terminals, circuit boards, connections, and other electronic controls for operation of the unit and which are shown schematicly in FIG. 15.

Figure 15:
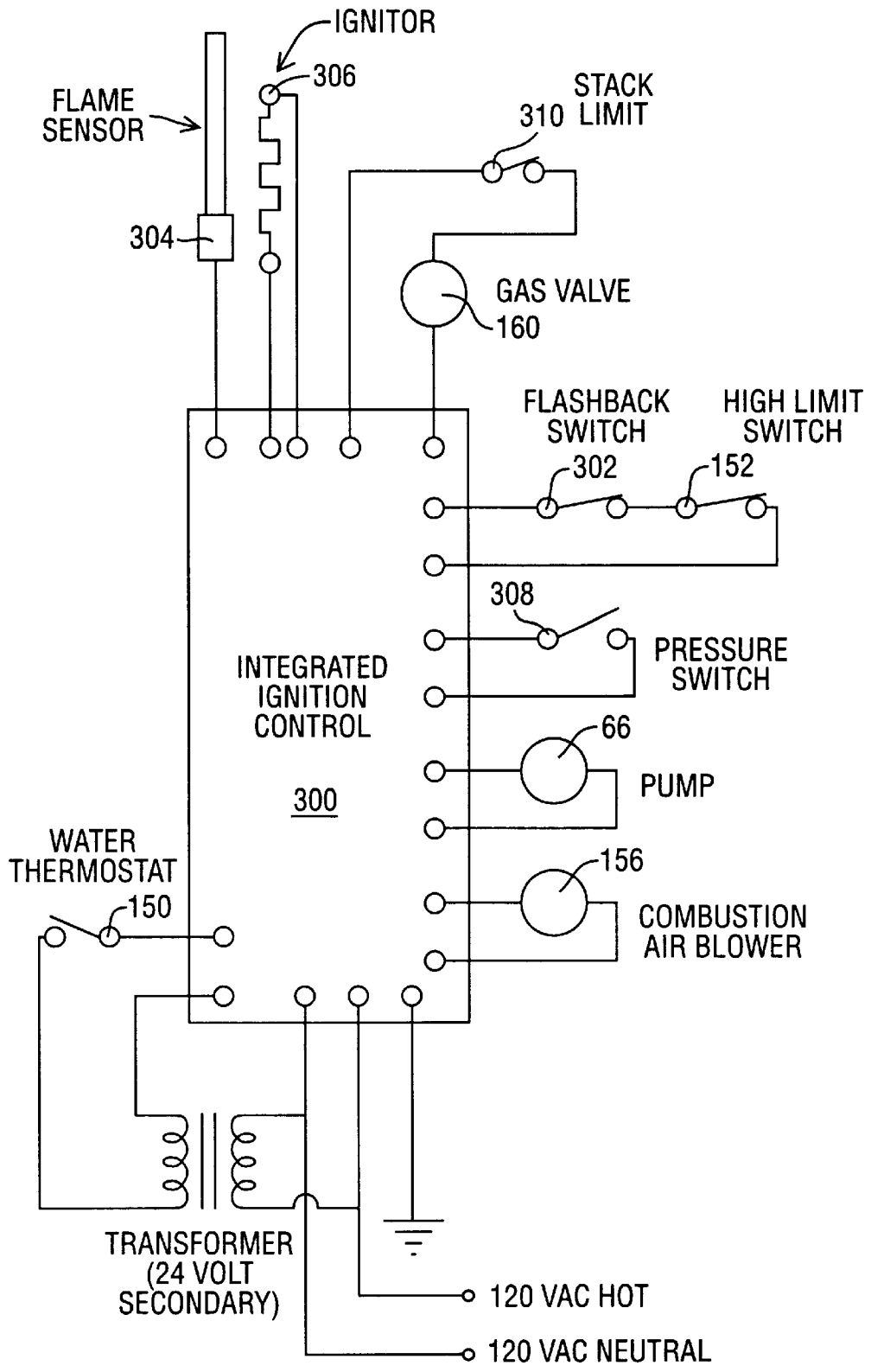
FIG. 15 is a schematic diagram of the electrical system control for the dynamic thermal stabilizing unit and input heat exchange unit.

Typically a conventional integrated ignition and component control unit 300 such as supplied by the White Rodgers Company (P/N 4026; St. Louis, Mo.), is used, although it is to be realized that manual controls may also be employed as is well known in the art. Referring to FIGS. 7, 10, and 15, the following components are used to control the input heat-exchange unit 40: a water-temperature thermostat 150 located near the bottom of the dynamic thermal stabilizer 20, a flame sensor 304, an ignitor 306, a high-limit dynamic thermal stabilizer temperature safety switch 152, a gas valve 160, a flash-back temperature switch 302, an air-flow pressure switch 308, pump 66, combustion air blower 156, and a high-limit flue (stack limit) temperature safety switch 310. Generally the flame sensor 304, high-limit dynamic thermal stabilizer safety switch 152, the stack limit switch 310, the flashback switch 302, and combustion air-flow pressure switch 308 are independent safety switches designed to stop gas flow to burner 108. The high-limit dynamic thermal stabilizer switch 152 prevents firing of the burner should the water temperature exceed a certain predetermined limit, e.g., 190° F. The stack limit switch 310 is designed to turn off the burner should the exhaust flue exceed a certain temperature, e.g., 350° F., as might occur should liquid fail to circulate through the heat exchange coil 106 due to blockage or pump failure. A flash back switch 302 may be used and is designed to turn off burner 108 should abnormally high temperatures be detected in blower tube 162 as a result of flash back and ignition of the air/gas mixture in the blower tube. Combustion air-flow pressure switch 308 prevents ignition or turns off burner 108 in the event a preset minimum pressure differential is not detected by pressure switch 308 in sealed subunit housing 110, such a lower differential occurring if a blockage occurs in the exhaust flue 114 or the intake air tube (thimble) 120 to restrict the air flow.

In operation, the dynamic thermal stabilizer switch 150 calls for input heat when the switch temperature falls below a predetermined value, e.g., 135° F. at which time the combustion air blower is activated for a prepurge of the combustion and exhaust passage and to establish a pressure differential at pressure switch 308 for gas valve activation. Provided all safety switches are closed, the gas valve 160 opens and ignitor 306 ignites the air/gas mixture. Should ignition not take place, flame sensor 304 closes gas valve 160. The burner continues to fire until the dynamic thermal stabilizer switch 150 reaches a preselected upper temperature, e.g., 150° F., at which point the gas valve is closed. After the burner turns off, pump 66 and combustion air blower 156 continue to operate for a preset post-purge period. Such a post-purge has the advantage of transferring additional heat from the exchange coil 106 to the liquid and returning it to the dynamic thermal stabilizer 20 and also prevents excessive heating of the water in the input heat-exchange unit 40 and resulting corrosion and scale build-up as a result of overheating the liquid in exchange coil 106.

Figure 11:
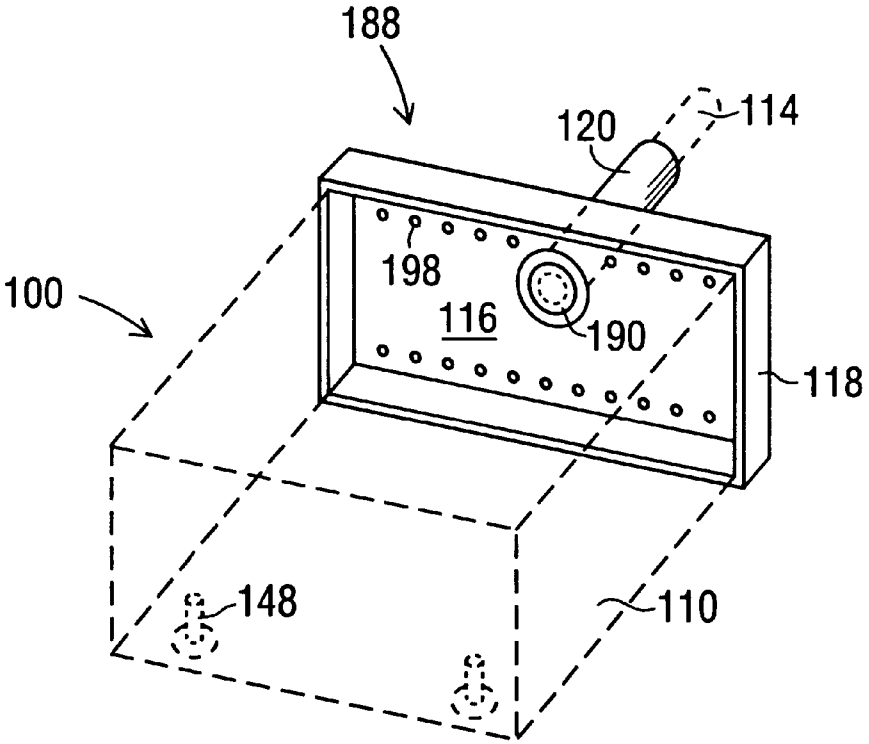
FIG. 11 is a perspective drawing of a mounting unit for the subunit housing of FIG. 7 which is shown in phantom.
Figure 12:
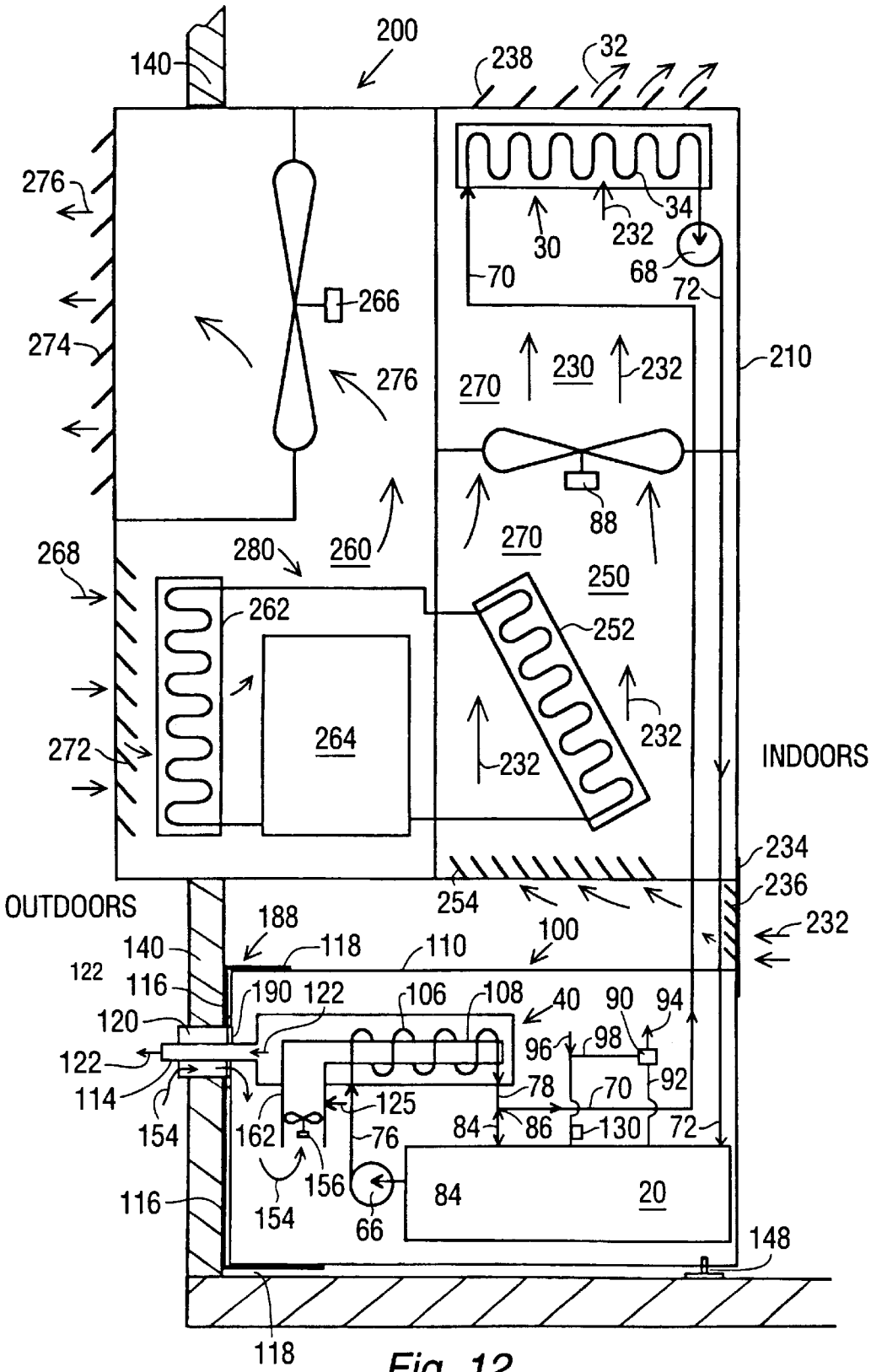
FIG. 12 is a cross-sectional schematic side view of a combination unit for air cooling and air and water heating mounted through an outside structural wall.
Figure 13:
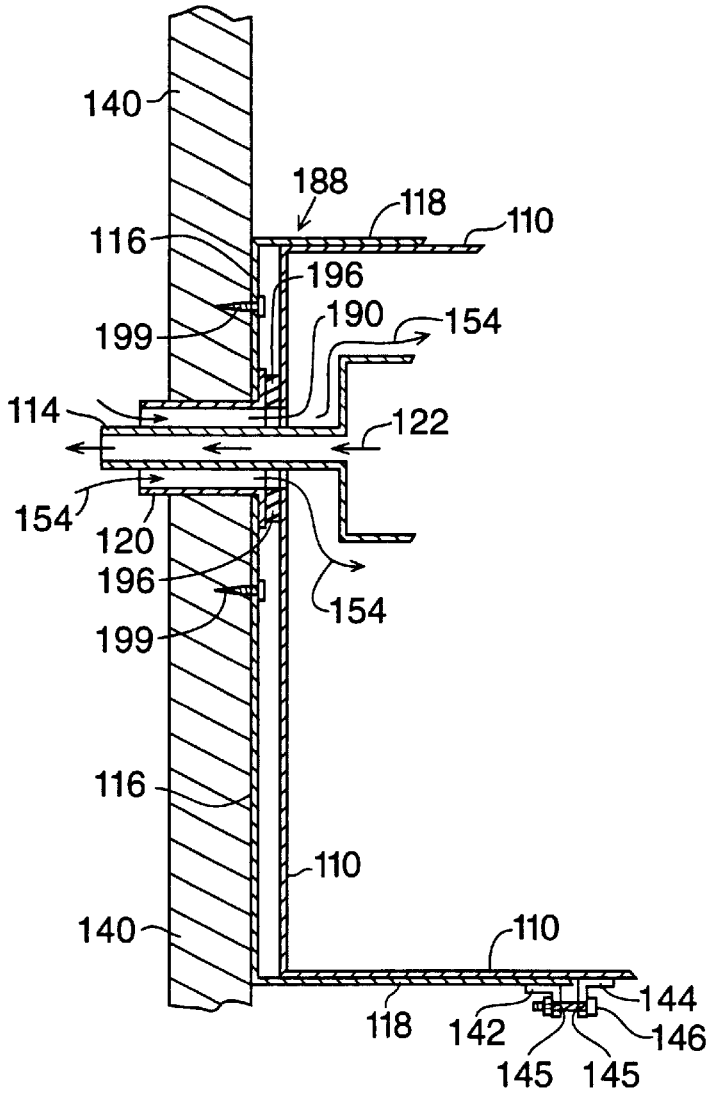
FIG. 13 is a cross sectional view of the mounting unit and a portion of the subunit housing mounted through an outside structural wall showing the sealed combustion air and exhaust system.

FIGS. 11–13 illustrate a mounting unit 188 for use with the subunit housing 110. The mounting unit 188 comprises a panel 116 having a thimble aperture 190 formed in it. The panel has a sidewall that extends outward at substantially a right angle to panel 116 to form a frame 118 for receiving a portion of the subunit housing 110. Although a rectangular frame 118 is shown, it is to be realized that other shapes are possible to accommodate other housing configurations. A combustion-air conduit herein referred to as thimble 120 is inserted into the thimble aperture 190 and extends outward at a right angle generally opposite the direction of frame 118. The exhaust conduit 114 extending from the subunit housing 110 is inserted into the thimble 120 and is maintained in spaced relation with thimble 120 by the sidewall frame 118. Combustion air 154 is drawn into the air-tight subunit housing 110 between the exhaust conduit 114 and the inner wall of thimble 120. Then the combustion air 154 is pulled into blower tube 162 by blower 156 and mixed with gas 125 from valve 160 for combustion in burner 108. Combustion products are then vented through exhaust tube 114. A sealed housing 110 along with seal 196 maintain a closed input combustion air and exhaust system. Mounting unit 188 provides for the rapid installation of subunit 100 with a reliable and accurately positioned, sealed combustion air and exhaust system.

To install subunit 100, the installer takes panel 116 with associated frame 118 and thimble cutout 190 and places it against an exterior wall at the desired location of subunit 100. A wall cutout is marked on the wall 140 using the thimble cutout as a template and a circular hole is cut into the wall. Thimble 120 is then attached to panel 116 using an appropriate fastener or other joining technique. The thimble 120 is inserted into the hole in the wall and panel 116 leveled and bolted to wall 140 using lag bolts 199 (or other appropriate fasteners) positioned in the appropriate mounting apertures 198 (FIG. 11) to bolt the unit 188 securely to the wall studs (not shown). The subunit housing 110 is then inserted into the frame with the exhaust pipe 114 extending through the thimble 120 and maintained in spaced relation with thimble 120 by means of frame 118. The subunit housing 110 is secured to the frame 118 using suitable fasteners such as tabs 142, 144 and nuts and bolts 146. Adjustable feet 148 are used to maintain subunit housing 110 in a level position.

As shown in FIGS. 17–23, various vent units may be provided on the outdoor wall of a building. The embodiment shown in FIGS. 17 and 18 comprises an inner exhaust deflector unit 400 and an outer covering unit 450. Inner deflector unit 400 has an opening 402 therein for receiving exhaust flue 114. For ease of assembly, opening 402 is of such size so as to form a force fit with exhaust pipe (flue) 114. Of course other conventional joining or securing techniques or fasteners may be used to join the exhaust flue 114 and the deflector unit 400. The deflector unit further comprises one or more openings 406 formed therein with associated deflector plates 404 for diverting the exhaust products 122 away from exterior wall 140.

The outer covering 450 is spaced apart from the inner exhaust deflector unit and can be attached to outer wall 140 or to thimble 120. The outer covering has one or more openings 452,454 formed in it for receiving combustion air and outdoor exhaust product cooling air 154. The top 456 and front portion 464 of covering 450 have no openings in order to avoid having elements such as debris and precipitation (e.g., rain and snow) being carried into housing 110 (FIG. 13) or otherwise blocking the exhaust flue 114 or the combustion-air thimble 120.

As an illustrative example, the deflector unit 400 is formed from sheet metal as a rectangular parallelepiped. The base 408 of the parallel piped has opening 402 cut therein to receive exhaust pipe 114. The ends are bent obliquely outward from base 408 and trimmed to form deflectors 404 and opening 406. The outer covering 450 may also be formed from sheet metal in the general form of a rectangular parallelepiped. The base of the parallelepiped is partially removed with the remaining portions bent outward at right angles to top 456 and bottom 458 to form flanges 460, 460'.

The flanges may have openings 462 for mounting covering 450 to wall 140 with a securing fastener. The ends are removed to form openings 452. The covering 450 is of such size as to be spaced apart from the exhaust unit 400 to such an extent that exhaust products 122 mix and are diluted and cooled sufficiently with the air to form diluted and cooled mixture 457 and thereby avoids excessive temperatures on the outer surfaces of outer covering 450. Openings 454 are provided in the bottom 458 to further increase the air supply for exhaust product cooling and combustion air supply. The top 456 and front 464 are solid (without openings) in order to prevent elements such as debris and weather (snow, rain, etc.) from blocking or entering thimble 120 or blocking the venting of exhaust products 122 and to temper the effects of high winds.

Figure 20:
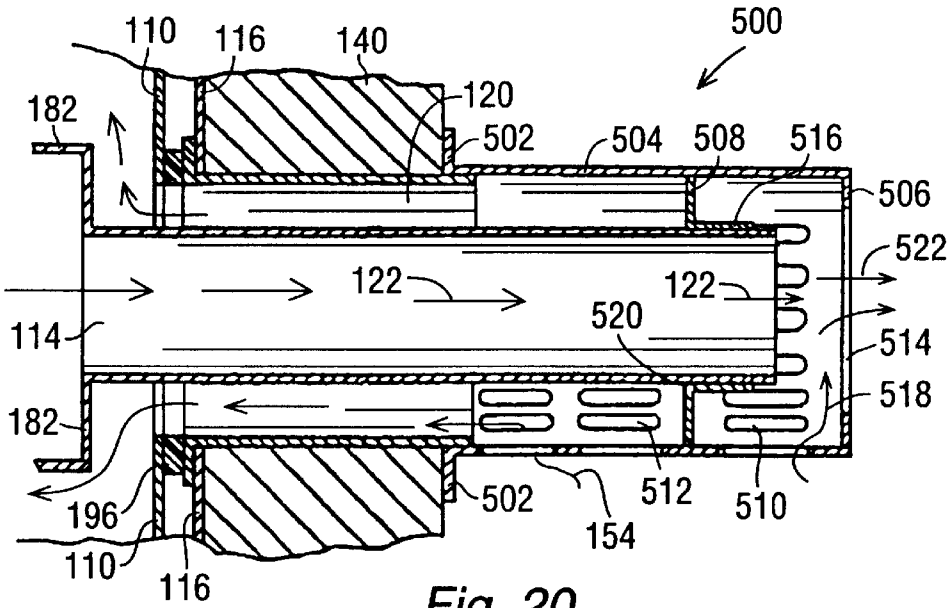
FIG. 20 is a cross-sectional view of the eductor embodiment shown in FIG. 19 along line 20—20.
Figure 19:
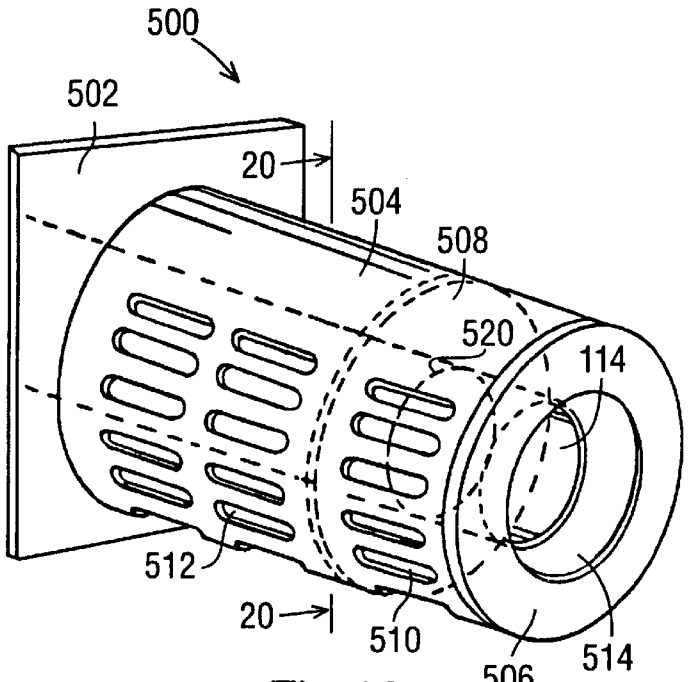
FIG. 19 is a perspective view of another embodiment of an eductor terminal designed for cool outer surface operation.

Another embodiment is shown in FIGS. 19 and 20 and is referred to generally as eductor terminal 500. Eductor terminal 500 comprises a hollow cylinder 504 with an exterior flange 502 at a first end. The interior diameter of cylinder 504 is such as to receive the outer end of thimble (air-supply conduit) 120, preferably in a force fit although the two may be joined with other fastening techniques including fasteners such as sheet metal screws. Flange 502 may be secured to wall 140 with suitable fasteners. Flange 502 may also be eliminated. Alternatively, cylinder 504 may be of such size as to be received by thimble 120 preferably in a force fit. An interior plate 508 is located toward the opposite (second) end of cylinder 504 and attached thereto and has formed therein a circular opening 520 for receiving the end of exhaust pipe 114. Exhaust pipe 114 terminates prior to reaching the second end of cylinder 504 with the distance between the second end of cylinder 504 and the end of exhaust pipe 114 of sufficient length so as to avoid casual contact with pipe 114. A cylindrical flange 516 may be attached to or formed as part of plate 508 to further secure exhaust pipe 114 by means of a force fit. An end cap 506 with an opening 514 formed therein partially closes the second end of cylinder 504. Apertures 510 are formed radially about cylinder 504 between interior flange 508 and the second end of cylinder 504. Inlet apertures 510 serve as a passage for outside diluent air 518 to enter the cylinder and dilute and cool the exhaust products emerging from exhaust pipe 114 and maintain cylinder 504 and end cap 506 at a cool temperature. The cool, diluted exhaust products then exit from cylinder 504 through opening 514. Inlet apertures 512 are formed radially about cylinder 504 between the first end of cylinder 504 and interior flange 508. Apertures 512 serve as a passage by which combustion air 154 enters cylinder 504 and passes into thimble 120 and then into input heat-exchanger housing 110. Typically apertures 510 and 512 are not formed in the upper portions of cylinder 504 to prevent debris and weather from entering the cylinder and either entering the heating unit or otherwise blocking the exhaust and/or combustion air passages.

Figure 22:
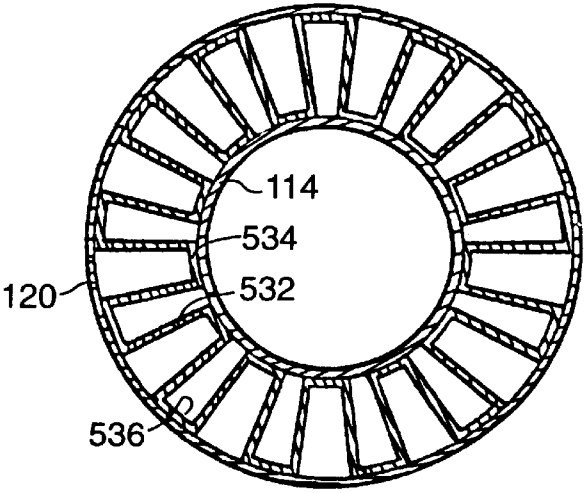
FIG. 22 is a cross-sectional view of the embodiment shown in FIG. 21 along line 22—22.
Figure 23:
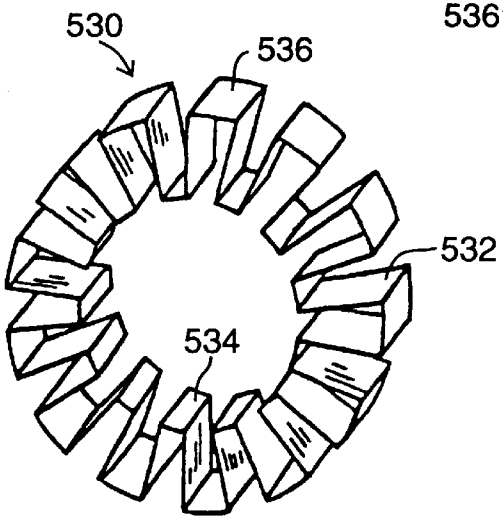
FIG. 23 is a perspective view of an air intake grill used with the terminal shown in FIGS. 21 and 22.
Figure 21:
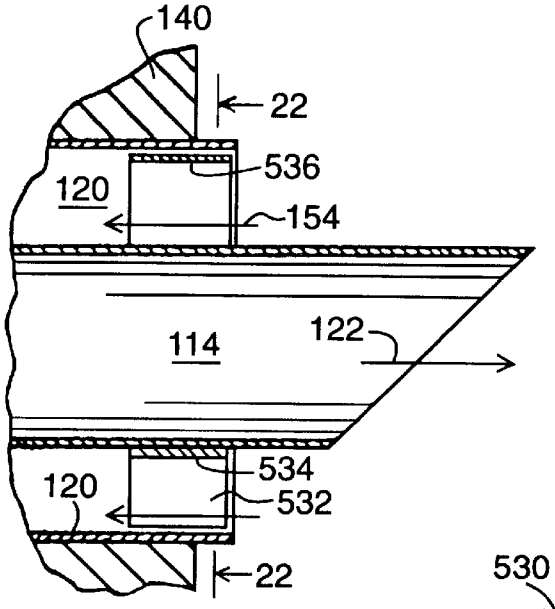
FIG. 21 is a cross-sectional view of yet a third exhaust-product terminal embodiment.

A third vent device 530 referred to as an apple slicer vent or spacer is shown in FIGS. 21–23. Such a device is intended for use at upper levels or in locations where there is minimal risk of contact with the hot exhaust pipe surfaces. Device 530 consists of a band formed as an annular set of radial spokes with each spoke 532 joined one to the next by alternating inner annular surfaces 534 and outer annular surfaces 536. The outer annular surfaces 536 contact the inner radial surface of air inlet thimble 120 while the inner annular surfaces 534 contact the outer radial surface of exhaust flue 114. The use of a thin, flat, elongate band minimizes the pressure drop of incoming combustion air 154 and also maintains thimble (combustion air conduit) 120 and exhaust flue 114 in spaced-apart relation.

As shown in FIG. 12, the output heat exchange unit 30 is located in a second subunit generally denoted by the numeral 200 which also contains pump 68 for returning liquid from the output heat exchange coil 34 back to the dynamic thermal stabilizer 20 by means of conduit 72. Hot liquid from either the dynamic thermal stabilizer 20 or the input heat exchange unit 40 is provided to the output heat exchange unit 30 from tee 86 by means of conduit 70. As noted previously, when air heating demand can be satisfied by the hot liquid in the dynamic thermal stabilizer 20, pump 66 is off and may serve as a check valve with pump 68 drawing hot liquid from the dynamic thermal stabilizer 20. When the input heat exchange unit (burner) is activated and hot liquid is available directly from the input heat exchanger 40, an additional heat boost is achieved at the output heat exchange unit 30. To provide the correct flow pattern without the use of two-way or three-way valves, pump 68 typically operates at a lesser pumping capacity than pump 66, typically at about 50% less pumping capacity.

Figure 14:
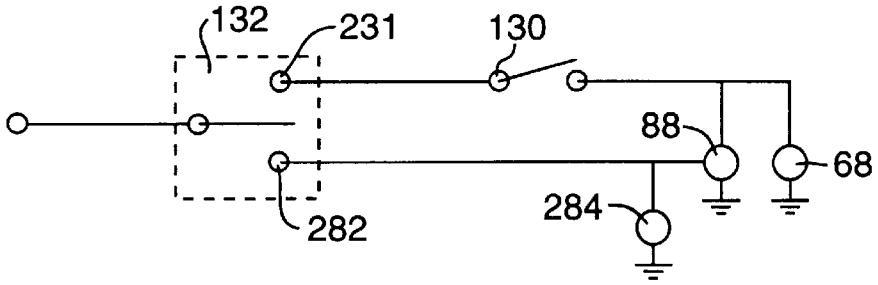
FIG. 14 is a schematic diagram of the electrical system for an air handling subunit that includes an output heat exchange unit and pump.

As shown in FIG. 14, a room thermostat 132 closes to contact 231 when the room temperature drops below a preset temperature. Priority switch 130 is typically closed causing fan 88 and pump 68 to be activated. Priority switch 130 is a temperature sensor located on the cold water input 96 close to the dynamic thermal stabilizer 20. When no cold water input is being received by the dynamic thermal stabilizer, input conduit 96 near the dynamic thermal stabilizer 20 tends to warm as a result of the hot fluid in stabilizer 20. When conduit 96 is above a preselected temperature, switch 130 is closed and pump 68 and fan 88 respond to the thermostatic control 132 and provide a warm air output 32. A hot water draw from outlet 94 causes cold water to flow through conduit 96 causing switch 130 to open and turn off fan 88 and pump 66. Such a prioritizing scheme has been found particularly effective for the system resulting in the capability of delivering a twenty-minute shower at a water temperature of not less than about 105° F. while allowing for only a 5° F. drop in room air temperature at an outdoor temperature of 5° F. and a make-up cold water temperature of 40° F.

Subunit 200 can also contain cooling unit 280, e.g., an air conditioner, in which case it is typically mounted through an exterior wall 140. The air conditioner is conventional with an interconnected evaporator 252, compressor 264, and a condenser 262. When both the output heat exchange unit 30 and the cooling unit 280 are placed in second subunit housing 210, the housing is further divided into two compartments, exterior air compartment 260 and interior compartment 270. Exterior compartment 260 contains an exhaust fan 266 that draws outdoor air 268 in through openings 272 and over the condenser 262 to remove condensation heat and exhausts the hot air 276 through openings 274.

Interior compartment 270 is further divided into subcompartments 230 and 250 containing the output heat exchange unit 30 with associated pump 68 and the evaporator 252, respectively. A common air handling unit 88 such as a fan or blower connects subcompartments 230 and 250 to form a common air path for both room-air heating and cooling. Typically return air 232 enters opening 236 of an optional subunit connecting panel 234 and passes into the evaporator compartment 250 through openings 254. The air is pulled over the evaporator coil 252 by fan 88 and passes into output heat exchange subcompartment 230 where it passes over output heat exchange coil 34 and then out of the output heat exchange subcompartment 230 through openings 238.

As seen in FIG. 14, the room thermostatic switch 132 controls operation of either the cooling unit 280 or the output heat-exchange unit 30 (FIG. 12). When switch 132 is in contact with the cooling unit circuit contact 282, cooling unit components 284 such as the compressor 264 and exhaust fan 266 are activated while output heat exchange pump 68 remains off. The common air handling unit (fan) 88 is on and draws return air 232 over the evaporator where heat is removed and then routes the cool conditioned air over the output heat exchange coil 34 (off) and out through the conditioned air outlet openings 238. When the room thermostatic switch 132 closes to contact 231 for heating, the cooling unit components 284 are off. Provided contact 130 is closed (no substantial hot water draw), the output heat exchange pump 68 is activated and hot liquid pumped through exchange coil 34. As with the cooling process, return air 232 is drawn through inlet openings 236, 254 in connecting panel 234 and evaporator subcompartment 250, respectively, over the evaporator 252 (off), through the air handling unit 88, and over the hot exchange coil 34 where the cold return air is heated and output through openings 238 in output heat exchange subcompartment 230 as conditioned hot air 32. Conditioned hot or cold air may be routed directly back to the room space or further directed through appropriate duct work to other rooms.

It is possible that changes in configurations to other than those shown could be used but that which is shown is preferred and typical. Without departing from the spirit of this invention, various air handling and heat-exchange components and fluids and means for interconnecting and controlling these components and fluids may be used. It is therefore understood that although the present invention has been specifically disclosed with the preferred embodiment and examples, modifications to the design concerning sizing, shape and component placement and interconnection will be apparent to those skilled in the art and such modifications and variations are considered to be equivalent to and within the scope of the disclosed invention and the appended claims.

What is claimed is:

1. A heating system comprising:

a) a dynamic thermal stabilizer;

b) an input heat exchanger;

c) an output heat exchanger;

d) said input heat exchanger connected to receive a liquid from said dynamic thermal stabilizer;

e) said dynamic thermal stabilizer connected to receive said liquid from said input heat exchanger;

f) said output heat exchanger connected to receive said liquid from said input heat exchanger;

g) said dynamic thermal stabilizer connected to receive said liquid from said output heat exchanger;

h) a first subunit housing containing said input heat exchanger and said dynamic thermal stabilizer;

i) an input heat-exchanger housing having:

1) said input heat exchanger contained therein;

2) a burner means for providing heat to said input heat exchanger; and 3) an exhaust means attached to said input heat exchanger housing for venting combustion products from said burner means;

j) said first subunit housing having a cutout therein for receiving a combustion air supply and said exhaust means; and k) a mounting unit for said subunit housing with said mounting unit comprising:

1) a mounting panel with said panel having a thimble cut-out therein;

2) a thimble aligned with said thimble cut-out and attached to said mounting panel in a substantially perpendicular direction to said panel and receiving said exhaust means therein; and 3) a sidewall extending forward from said mounting panel in a direction substantially perpendicular to said panel and opposite said thimble, said sidewall forming a frame for receiving a portion of said subunit housing and maintaining said exhaust means in spaced apart relation with said thimble.

2. The heating system of claim 1 with said output heat exchanger connected to receive selectively said liquid from said input heat exchanger and said dynamic thermal stabilizer.

3. The heating system of claim 2 further comprising a first circulating means for circulating said liquid, said circulating means located between said dynamic thermal stabilizer and said input heat exchanger.

4. The heating system of claim 3 further comprising a second circulating means for circulating said liquid, said second circulating means located between said output heat exchanger and said dynamic thermal stabilizer.

5. The heating system of claim 1 with said dynamic thermal stabilizer connected to receive cold liquid from a liquid source.

6. The heating system of claim 5 with said dynamic thermal stabilizer connected to deliver hot liquid to a hot liquid output.

7. The heating system of claim 6 further comprising a mixing means for receiving hot liquid from said hot liquid output and cold liquid from said liquid source and delivering liquid at a preselected temperature to a heated liquid output.

8. The heating system of claim 5 further comprising an output heat exchanger control means for controlling a flow of liquid through said output heat exchanger in response to a sensing means located in proximity to a cold liquid inlet to said dynamic thermal stabilizer.

9. The heating system of claim 1 comprising thermal insulating material surrounding at least a portion of said dynamic thermal stabilizer.

10. The heating system of claim 9 wherein said thermal insulating material is of rigid form and conforms substantially to at least a portion of two adjacent sides of said first subunit housing.

11. The heating system of claim 1 wherein said input heat exchanger is formed from finned tubing as a helical annular coil having about its substantially annular exterior surface a deflection means for deflecting combustion products to contact substantially the exterior surfaces of said finned tubing.

12. The heating system of claim 11 wherein said deflection means is an annular shroud with said shroud having formed therein apertures for venting combustion products from said burner means, said apertures formed to align with said tubing coil at its outermost radial extent.

13. The heating system of claim 12 with said annular shroud having an internal helical groove mating with said helical coil.

14. The heating system of claim 11 wherein said deflection means is a helical cover positioned over that portion of the coil windings where the windings are adjacent to each other.

15. The heating system of claim 14 wherein said helical cover comprises a band.

16. The heating system of claim 1 further comprising a second subunit housing containing said output heat exchanger.

17. The heating system of claim 16 with said second subunit housing containing a cooling unit comprising an interconnected evaporator, compressor and condenser.

18. The heating system of claim 17 further comprising an air-handling means common to both said output heat exchanger and said evaporator.

19. The heating system of claim 1 comprising:

a) a vent attached to said exhaust means; and b) a thimble for providing said combustion-air supply.

20. The heating system of claim 19 with said vent comprising a spacer for maintaining said exhaust means and said thimble in spaced-apart relation.

21. The heating system of claim 20 with said spacer comprising radial spokes joined one to the next by alternating interior and exterior annular surfaces with said interior annular surfaces contacting an outer surface of said exhaust means and said exterior annular surfaces contacting an inner surface of said thimble.

22. The heating system of claim 19 with said vent comprising:

a) an inner exhaust deflector attached to said exhaust means; and b) an outer covering means spaced apart from said inner exhaust deflector to 1) prevent elements from entering said exhaust means and said thimble; and 2) dilute and cool said combustion products to maintain said covering means at a cool temperature.

23. The heating system of claim 19 with said vent being an eductor terminal comprising a hollow cylinder with:

a) a first end and a second end with said first end attached to said thimble;

b) an interior plate attached to an interior surface of said hollow cylinder toward said second end of said cylinder and having an opening therein to receive an end of said exhaust means;

c) at least one first aperture formed in said cylinder between said interior plate and said first end of said cylinder for receiving said combustion-air supply; and d) at least one second aperture formed in said cylinder between said interior plate and said second end of said cylinder for receiving outside diluent air.

24. A heating system comprising a first housing having therein a) a dynamic thermal stabilizer comprising:

1) a cold-water input;

2) an output heat exchanger input for receiving water from an output heat exchanger;

3) an input heat-exchanger output for providing water to an input heat exchanger;

4) a hot-water output; and 5) a combined input heat exchanger input/output heat exchanger output for selectively receiving hot water from said input heat-exchanger and providing hot water to said output heat exchanger;

b) an input heat-exchanger housing containing said input heat exchanger with said input heat exchanger comprising:

1) an input heat exchanger input connected to said dynamic thermal stabilizer input heat-exchanger output; and 2) an input heat-exchanger output;

c) a tee connection connected to:

1) said input heat-exchanger output; and 2) said dynamic thermal stabilizer combined input heat-exchanger input/output heat-exchanger output; and 3) said tee connection having a tee output for providing water to said output heat exchanger; and d) a mounting unit for said first housing comprising:

1) a mounting panel having an opening for receiving a combustion-air conduit;

2) said combustion-air conduit attached to said mounting panel in a substantially perpendicular orientation to said panel and receiving an exhaust flue therein; and 3) a sidewall extending forward at substantially a right angle to said panel in a direction opposite said orientation of said combustion-air conduit and forming a frame for receiving a portion of said first housing and maintaining said exhaust flue in spaced-apart relation with said combustion-air conduit.

25. The heating system of claim 24 with said first housing further containing a first circulating means connected between said dynamic thermal stabilizer input heat-exchanger output and said input heat exchanger input.

26. The heating system of claim 24 with said first housing further containing a sensing means located in proximity to said cold-water input for turning on and off said output heat exchanger.

27. The heating system of claim 24 with said first housing containing insulating material surrounding at least a portion of said dynamic thermal stabilizer and conforming substantially to a portion of an interior of said first housing.

28. The heating system of claim 24 with said first housing having sealing means to form an airtight enclosure and said first housing having formed therein an aperture for receiving said exhaust flue and a combustion air supply.

29. The heating system of claim 24 with said first housing containing a burner control means to operate a combustion air blower and a first circulating means after said burner is shut off for a predetermined post-purge period.

30. The heating system of claim 24 further comprising a second housing containing said output heat exchanger.

31. The heating system of claim 30 wherein said second housing contains a second circulating means connected to an output heat-exchanger output and said dynamic thermal stabilizer output heat-exchanger input.

32. The heating system of claim 30 with said second housing containing an interconnected evaporator, compressor and condenser.

33. The heating system of claim 32 with said second housing containing an air-handling means common to said evaporator and said output heat exchanger.

34. A heating system comprising a first housing having therein a) a dynamic thermal stabilizer comprising:

1) a cold-water input;

2) an output heat exchanger input for receiving water from an output heat exchanger;

3) an input heat-exchanger output for providing water to an input heat exchanger;

4) a hot-water output; and 5) a combined input heat exchanger input/output heat exchanger output for selectively receiving hot water from said input heat-exchanger and providing hot water to said output heat exchanger; and 6) a sensing means located in proximity to said cold-water input for turning on and off said output heat exchanger;

b) an input heat-exchanger housing containing said input heat exchanger with said input heat exchanger comprising:

1) an input heat exchanger input connected to said dynamic thermal stabilizer input heat-exchanger output; and 2) an input heat-exchanger output; and c) a tee connection connected to:

1) said input heat-exchanger output; and 2) said dynamic thermal stabilizer combined input heat-exchanger input/output heat-exchanger output; and 3) said tee connection having a tee output for providing water to said output heat exchanger.

35. The heating system of claim 34 with said first housing further containing a first circulating means connected between said dynamic thermal stabilizer input heat-exchanger output and said input heat exchanger input.

36. The heating system of claim 34 with said first housing containing insulating material surrounding at least a portion of said dynamic thermal stabilizer and conforming substantially to a portion of an interior of said first housing.

37. The heating system of claim 34 with said first housing having sealing means to form an airtight enclosure and said first housing having formed therein an aperture for receiving said exhaust flue and a combustion air supply.

38. The heating system of claim 34 with said first housing containing a burner control means to operate a combustion air blower and a first circulating means after said burner is shut off for a predetermined post-purge period.

39. The heating system of claim 34 further comprising a second housing containing said output heat exchanger.

40. The heating system of claim 39 wherein said second housing contains a second circulating means connected to an output heat-exchanger output and said dynamic thermal stabilizer output heat-exchanger input.

41. The heating system of claim 39 with said second housing containing an interconnected evaporator, compressor and condenser.

42. The heating system of claim 41 with said second housing containing an air-handling means common to said evaporator and said output heat exchanger.

* * * * *